US010142755B2

(12) United States Patent
Boland

(10) Patent No.: US 10,142,755 B2
(45) Date of Patent: Nov. 27, 2018

(54) SIGNAL PROCESSING METHODS AND SYSTEMS FOR RENDERING AUDIO ON VIRTUAL LOUDSPEAKER ARRAYS

(71) Applicant: Google Inc., Mountain View, CA (US)

(72) Inventor: Francis Morgan Boland, Dublin (IE)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 15/426,629

(22) Filed: Feb. 7, 2017

(65) Prior Publication Data

US 2017/0245082 A1 Aug. 24, 2017

Related U.S. Application Data

(60) Provisional application No. 62/296,934, filed on Feb. 18, 2016.

(51) Int. Cl.

| | |
|---|---|
| ***H04S 1/00*** | (2006.01) |
| ***H04S 3/02*** | (2006.01) |
| ***H04S 7/00*** | (2006.01) |

(52) U.S. Cl.

CPC ..... *H04S 1/005* (2013.01); *H04S 3/02* (2013.01); *H04S 7/306* (2013.01);

(Continued)

(58) Field of Classification Search

CPC ..... H04S 1/005; H04S 7/306; H04S 7/305; H04S 2420/07; H04S 2420/01;

(Continued)

(56) References Cited

U.S. PATENT DOCUMENTS 5,500,900 A 3/1996 Chen et al.
5,757,927 A * 5/1998 Gerzon ..... H04S 3/02 381/18

(Continued)

FOREIGN PATENT DOCUMENTS

CN 101040565 A 9/2007
CN 104408040 A 3/2015

(Continued)

OTHER PUBLICATIONS

Adams, Norman H. "Low-Order State-Space Models of Head-Related Transfer Function (HRTF) Arrays", Mar. 16, 2007 http://www.eecs.umich.edu/techreports/systems/cspl/cspl-379.pdf.*

(Continued)

*Primary Examiner* — Yogeshkumar Patel
(74) *Attorney, Agent, or Firm* — Brake Hughes Bellermann LLP

(57) ABSTRACT

Techniques of rendering audio involve applying a balanced-realization state space model to each head-related transfer function (HRTF) to reduce the order of an effective FIR or even an infinite impulse response (IIR) filter. Along these lines, each HRTF G(z) is derived from a head-related impulse response filter (HRIR) via, e.g., a z-transform. The data of the HRIR may be used to construct a first state space representation [A, B, C, D] of the HRTF via the relation $G(z)=C(zI-A)^{-1}B+D$ This first state space representation is not unique and so for an FIR filter, A and B may be set to simple, binary-valued arrays, while C and D contain the HRIR data. This representation leads to a simple form of a Gramian Q whose eigenvectors provide system states that maximize the system gain as measured by a Hankel norm.

20 Claims, 18 Drawing Sheets

(52) U.S. Cl.
CPC ..... *H04S 2400/01* (2013.01); *H04S 2420/01* (2013.01); *H04S 2420/07* (2013.01); *H04S 2420/11* (2013.01)

(58) Field of Classification Search
CPC ..... H04S 2420/11; H04S 3/00; H04S 3/004; H04S 5/00; H04S 5/005; H04S 2400/01; H04S 3/02; H04S 7/303; H04S 7/302; H04S 7/304; H04S 7/30; H04S 3/008; H04R 27/00; H04R 5/04; H04R 5/033; H04R 25/552; H04R 3/00; H04R 5/02; H04R 1/1075; H04R 2499/11; H04R 2201/401; H04R 2225/43
USPC ..... 381/17
See application file for complete search history.

(56) References Cited

U.S. PATENT DOCUMENTS 6,243,476 B1 * 6/2001 Gardner ..... H04S 1/007 381/1
7,715,575 B1 * 5/2010 Sakurai ..... H04S 3/002 381/300
8,160,258 B2 * 4/2012 Jung ..... G10L 19/008 381/2
8,989,417 B1 * 3/2015 Zhong ..... H04R 5/033 381/312
9,124,983 B2 * 9/2015 Recker ..... H04R 25/40
9,464,912 B1 * 10/2016 Smus ..... G01C 21/3629
9,510,127 B2 * 11/2016 Squires ..... H04S 7/306
9,560,467 B2 * 1/2017 Gorzel ..... G10L 19/00
9,584,946 B1 * 2/2017 Lyren ..... H04S 7/30
9,609,436 B2 * 3/2017 Gamper ..... H04R 5/0335
9,641,951 B2 * 5/2017 Atkins ..... H04S 7/301
9,906,884 B2 * 2/2018 Meshram ..... H04S 7/303
2006/0018497 A1 * 1/2006 Kornagel ..... H04R 25/552 381/315
2006/0045294 A1 3/2006 Smyth et al.
2006/0062409 A1 3/2006 Sferrazza
2006/0206560 A1 * 9/2006 Kanada ..... H04L 29/06027 709/201
2007/0071204 A1 * 3/2007 Kanada ..... H04M 3/4878 379/158
2009/0046864 A1 * 2/2009 Mahabub ..... H04S 7/30 381/17
2009/0067636 A1 * 3/2009 Faure ..... H04S 1/00 381/17
2009/0103738 A1 * 4/2009 Faure ..... H04S 1/005 381/17
2009/0232317 A1 * 9/2009 Emerit ..... H04S 1/007 381/17
2009/0252356 A1 * 10/2009 Goodwin ..... G10L 19/173 381/310
2011/0026745 A1 * 2/2011 Said ..... H04S 1/002 381/310
2011/0305345 A1 * 12/2011 Bouchard ..... G10L 21/0208 381/23.1
2012/0213375 A1 * 8/2012 Mahabub ..... H04S 5/00 381/17
2013/0036452 A1 * 2/2013 Yamashita ..... G06F 21/31 726/3
2013/0041648 A1 * 2/2013 Osman ..... H04S 7/304 704/2
2013/0064375 A1 * 3/2013 Atkins ..... H04S 7/301 381/17
2013/0208897 A1 * 8/2013 Vincent ..... H04S 7/303 381/17
2013/0208898 A1 * 8/2013 Vincent ..... H04S 7/303 381/17
2013/0208899 A1 * 8/2013 Vincent ..... H04S 7/303 381/17
2013/0208900 A1 * 8/2013 Vincent ..... H04S 7/303 381/17
2013/0208926 A1 * 8/2013 Vincent ..... H04S 7/303 381/300
2013/0272527 A1 * 10/2013 Oomen ..... G10K 15/12 381/17
2014/0198918 A1 * 7/2014 Li ..... H04S 7/30 381/26
2014/0270189 A1 * 9/2014 Atkins ..... H04S 3/00 381/17
2015/0119130 A1 * 4/2015 Lovitt ..... A63F 13/00 463/23
2015/0223002 A1 * 8/2015 Mehta ..... H04S 7/30 381/303
2015/0230040 A1 * 8/2015 Squires ..... H04S 7/306 381/303
2015/0293655 A1 * 10/2015 Tan ..... G06F 3/0486 715/727
2015/0304790 A1 * 10/2015 Yamashita ..... G06F 21/32 381/303
2015/0340043 A1 * 11/2015 Koppens ..... G10L 19/002 704/500
2015/0350801 A1 * 12/2015 Koppens ..... H04S 1/005 381/1
2015/0358754 A1 * 12/2015 Koppens ..... H04S 1/005 381/17
2016/0037281 A1 * 2/2016 Atkins ..... G06F 17/156 381/17
2016/0198281 A1 * 7/2016 Oh ..... H04S 3/00 381/310
2016/0227338 A1 * 8/2016 Oh ..... H04S 7/303
2016/0277865 A1 * 9/2016 Lee ..... H04S 3/00
2016/0323688 A1 * 11/2016 Lee ..... G10L 19/008
2016/0373877 A1 * 12/2016 Laitinen ..... H04S 7/304
2017/0019746 A1 * 1/2017 Oh ..... H04S 3/008
2017/0045941 A1 * 2/2017 Tokubo ..... G06F 3/013
2017/0188174 A1 * 6/2017 Lee ..... H04S 7/303
2017/0188175 A1 * 6/2017 Oh ..... H04S 7/303
2017/0215018 A1 * 7/2017 Rosset ..... H04S 3/002
2017/0289728 A1 * 10/2017 Yamashita ..... G06F 21/32
2017/0346951 A1 * 11/2017 Pang ..... H04M 3/568
2018/0027349 A1 * 1/2018 Osman ..... H04S 7/304
2018/0048975 A1 * 2/2018 Oh ..... G10L 19/20
2018/0048981 A1 * 2/2018 Lee ..... H04S 7/307
2018/0091927 A1 * 3/2018 Lee ..... H04S 7/303

FOREIGN PATENT DOCUMENTS

CN 105376690 A * 3/2016
EP 1691578 A2 8/2006
KR 10-2010-0071617 A 6/2010
WO WO 2014/147442 A1 * 9/2014
WO 2017/142759 A1 8/2017

OTHER PUBLICATIONS

International Search Report and Written Opinion for PCT Patent Application No. PCT/US2017/017000, dated Apr. 7, 2017, 14 pages.
Combined Search and Examination Report for GB Patent Application No. GB1702673.3, dated Aug. 16, 2017, 7 pages.
Mackenzie, et al., "Low-Order Modeling of Head-Related Transfer Functions Using Balanced Model Truncation", IEEE Signal Processing Letters, vol. 4, No. 2, Feb. 1997, pp. 39-41.
First Office Action (with English translation) for Chinese Application No. 2017100868624, dated Jun. 28, 2018, 10 pages.
International Preliminary Report on Patentability for International Application No. PCT/US2017/01700, dated Aug. 30, 2018, 7 pages.

* cited by examiner

SIGNAL PROCESSING METHODS AND SYSTEMS FOR RENDERING AUDIO ON VIRTUAL LOUDSPEAKER ARRAYS

RELATED APPLICATION

This application is a non-provisional of, and claims priority to, U.S. Provisional Application No. 62/296,934, filed on Feb. 18, 2016, entitled "Signal Processing Methods and Systems for Rendering Audio on Virtual Loudspeaker Arrays," the disclosure of which is incorporated herein in its entirety.

BACKGROUND

A virtual array of loudspeakers surrounding a listener is commonly used in the creation of a virtual spatial acoustic environment for headphone delivered audio. The sound field created by this speaker array can be manipulated to deliver the effect of sound sources moving relative to the user or in order to stabilize the source at fixed spatial location when the user moves their head. These are operations that are of major importance to the delivery of audio through headphones in Virtual Reality (VR) systems.

The multi-channel audio, which is processed for delivery to the virtual loudspeakers, is combined to provide a pair of signals to the left and right headphone speakers. This process of combination of multi-channel audio is known as binaural rendering. The commonly accepted most effective way of implementing this rendering is to use a multi-channel filtering system that implements Head Related Transfer Functions (HRTFs). In a system based on a number, for example, M, (where M is an arbitrary number) of virtual loudspeakers, the binaural renderer will need to have 2M HRTF filter as a pair is used per loudspeaker to model the transfer function between the loudspeaker and the user's left and right ears.

SUMMARY

Conventional approaches to performing binaural rendering require large amounts of computational resources. Along these lines, when an HRTF is represented as a finite impulse response (FIR) filter of order n, each binaural output requires 2 M n multiply and addition operations per channel. Such operations may tax the limited resources allotted for binaural rendering in, for example, virtual reality applications.

In contrast to the conventional approaches to performing binaural rendering which require large amounts of computational resources, improved techniques involve applying a balanced-realization state space model to each HRTF to reduce the order of an effective FIR or even an infinite impulse response (IIR) filter. Along these lines, each HRTF G(z) is derived from a head-related impulse response filter (HRIR) via, e.g., a z-transform. The data of the HRIR may be used to construct a first state space representation [A, B, C, D] of the HRTF via the relation $G(z)=C(zI-A)^{-1}B+D$. This first state space representation is not unique and so for an FIR filter, A and B may be set to simple, binary-valued arrays, while C and D contain the HRIR data. This representation leads to a simple form of a Gramian Q whose eigenvectors provide system states that maximize the system gain as measured by a Hankel norm. Further, a factorization of Q provides a transformation into a balanced state space in which the Gramian is equal to a diagonal matrix of the eigenvalues of Q. By considering only those states associated with an eigenvalue greater than some threshold, the balanced state space representation of the HRTF may be truncated to provide an approximate HRTF that approximates the original HRTF very well while reducing the amount of computation required by as much as 90%.

One general aspect of the improved techniques includes a method of rendering sound fields in a left ear and a right ear of a human listener, the sound fields being produced by a plurality of virtual loudspeakers. The method can include obtaining, by processing circuitry of a sound rendering computer configured to render the sound fields in the left ear and the right ear of the head of the human listener, a plurality of head-related impulse responses (HRIRs), each of the plurality of HRIRs being associated with a virtual loudspeaker of the plurality of virtual loudspeakers and an ear of the human listener, each of the plurality of HRIRs including samples of a sound field produced at a specified sampling rate in a left or right ear produced in response to an audio impulse produced by that virtual loudspeaker. The method can also include generating a first state space representation of each of the plurality of HRIRs, the first state space representation including a matrix, a column vector, and a row vector, each of the matrix, the column vector, and the row vector of the first state space representation having a first size. The method can further include performing a state space reduction operation to produce a second state space representation of each of the plurality of HRIRs, the second space representation including a matrix, a column vector, and a row vector, each of the matrix, the column vector, and the row vector of the second state space representation having a second size that is less than first size. The method can further include producing a plurality head-related transfer functions (HRTFs) based on the second state representation, each of the plurality of HRTFs corresponding to a respective HRIR of the plurality of HRIRs, an HRTF corresponding to a respective HRIR producing, upon multiplication by a frequency-domain sound field produced by the virtual loudspeaker with which the respective HRIR is associated, a component of a sound field rendered in an ear of the human listener.

Performing the state space reduction operation can include, for each HRIR of the plurality of HRIRs, generating a respective Gramian matrix based on the first state space representation of that HRIR, the Gramian matrix having a plurality of eigenvalues arranged in descending order of magnitude, and generating the second state space representation of that HRIR based on the Gramian matrix and the plurality of eigenvalues, wherein the second size is equal to a number of eigenvalues of the plurality of eigenvalues greater than a specified threshold.

Generating the second state space representation of each HRIR of the plurality of HRIRs can include forming a transformation matrix that, when applied to the Gramian matrix that is based on the first state space representation of that HRIR, produces a diagonal matrix, each diagonal element of the diagonal matrix being equal to a respective eigenvalue of the plurality of eigenvalues.

The method can further include, for each of the plurality of HRIRs, generating a cepstrum of that HRIR, the cepstrum having causal samples taken at positive times and non-causal samples taken at negative times, for each of the non-causal samples of the cepstrum, performing a phase minimization operation by adding that non-causal sample taken at a negative time to a causal sample of the cepstrum taken at the opposite of that negative time, and producing a minimum-phase HRIR by setting each of the non-causal samples of the cepstrum to zero after performing the phase minimization operation for each of the non-causal samples of the cepstrum.

The method can further include generating a multiple input, multiple output (MIMO) state space representation, the MIMO state space representation including a composite matrix, a column vector matrix, and a row vector matrix, the composite matrix of the MIMO state space representation including the matrix of the first representation of each of the plurality HRIRs, the column vector matrix of the MIMO state space representation including the column vector of the first representation of each of the plurality HRIRs, the row vector matrix of the MIMO state space representation including the row vector of the first representation of each of the plurality HRIRs. In this case, performing the state space reduction operation includes generating a reduced composite matrix, a reduced column vector matrix, and a reduced row vector matrix, each of the reduced composite matrix, reduced column vector matrix, and reduced row vector matrix having a size that is respectively less than a size of the composite matrix, the column vector matrix, and the row vector matrix.

Generating the MIMO state space representation can include forming, as the composite matrix of the MIMO state space representation, a first block matrix having a matrix of the first state space representation of an HRIR associated with a virtual loudspeaker of the plurality of virtual loudspeakers as a diagonal element of the first block matrix, matrices of the first state space representation of HRIRs associated with the same virtual loudspeaker being in adjacent diagonal elements of the first block matrix. Generating the MIMO state space representation can also include forming, as the column vector matrix of the MIMO state space representation, a second block matrix having a column vector of the first state space representation of an HRIR associated with a virtual loudspeaker of the plurality of virtual loudspeakers as a diagonal element of the second block matrix, column vectors of the first state space representation of HRIRs associated with the same virtual loudspeaker being in adjacent diagonal elements of the second block matrix. Generating the MIMO state space representation can further include forming, as the row vector matrix of the MIMO state space representation, a third block matrix having a row vector of the first state space representation of an HRIR associated with a virtual loudspeaker of the plurality of virtual loudspeakers as an element of the third block matrix, row vectors of the first state space representation of HRIRs that render sounds in the left ear being in odd-numbered elements of the first row of the third block matrix, row vectors of the first state space representation of HRIRs that render sounds in the right ear being in even-numbered elements of the second row of the third block matrix.

The method can further include, prior to generating the MIMO state space representation, for each HRIR of the plurality of HRIRs, performing a single input single output (SISO) state space reduction operation to produce, as the first state space representation of that HRIR, a SISO state space representation of that HRIR.

Regarding the method, for each of the plurality of virtual loudspeakers, there are a left HRIR and a right HRIR of the plurality of HRIRs associated with that virtual loudspeaker, the left HRIR producing, upon multiplication by the frequency-domain sound field produced by that virtual loudspeaker, the component of the sound field rendered in the left ear of the human listener, the right HRIR producing, upon multiplication by the frequency-domain sound field produced by that virtual loudspeaker, the component of the sound field rendered in the right ear of the human listener. Further, for each of the plurality of virtual loudspeakers, there is an interaural time delay (ITD) between the left HRIR associated with that virtual loudspeaker and the right HRIR associated with that virtual loudspeaker, the ITD being manifested in the left HRIR and the right HRIR by a difference between a number of initial samples of the sound field of the left HRIR that have zero values and a number of initial samples of the sound field of the right HRIR that have zero values. In this case, the method can further include generating an ITD unit subsystem matrix based on the ITD between the left HRIR and right HRIR associated with each of the plurality of virtual loudspeakers, and multiplying the plurality of HRTFs by the ITD unit subsystem matrix to produce a plurality of delayed HRTFs.

Regarding the method, each of the plurality of HRTFs can be represented by finite impulse filters (FIRs). In this case, the method can further include performing a conversion operation on each of the plurality of HRTFs to produce another plurality of HRTFs that are each represented by infinite impulse response filters (IIRs).

Regarding the method, for each of the plurality of virtual loudspeakers, there is a HRIR associated with that virtual loudspeaker that corresponds to the ear on the side of the head nearest the loudspeaker, this is called the ipsilateral HRIR. The other HRIR associated with that virtual loudspeaker is called the contralateral HRIR. The plurality of HRTFs can be partitioned into two groups. One group contains all the ipsilateral HRTFs and the other group contains all the contralateral HRTFs. In this case, the method can be applied independently to each group and thereby produce a degree of approximation appropriate to that group.

Figure 1:
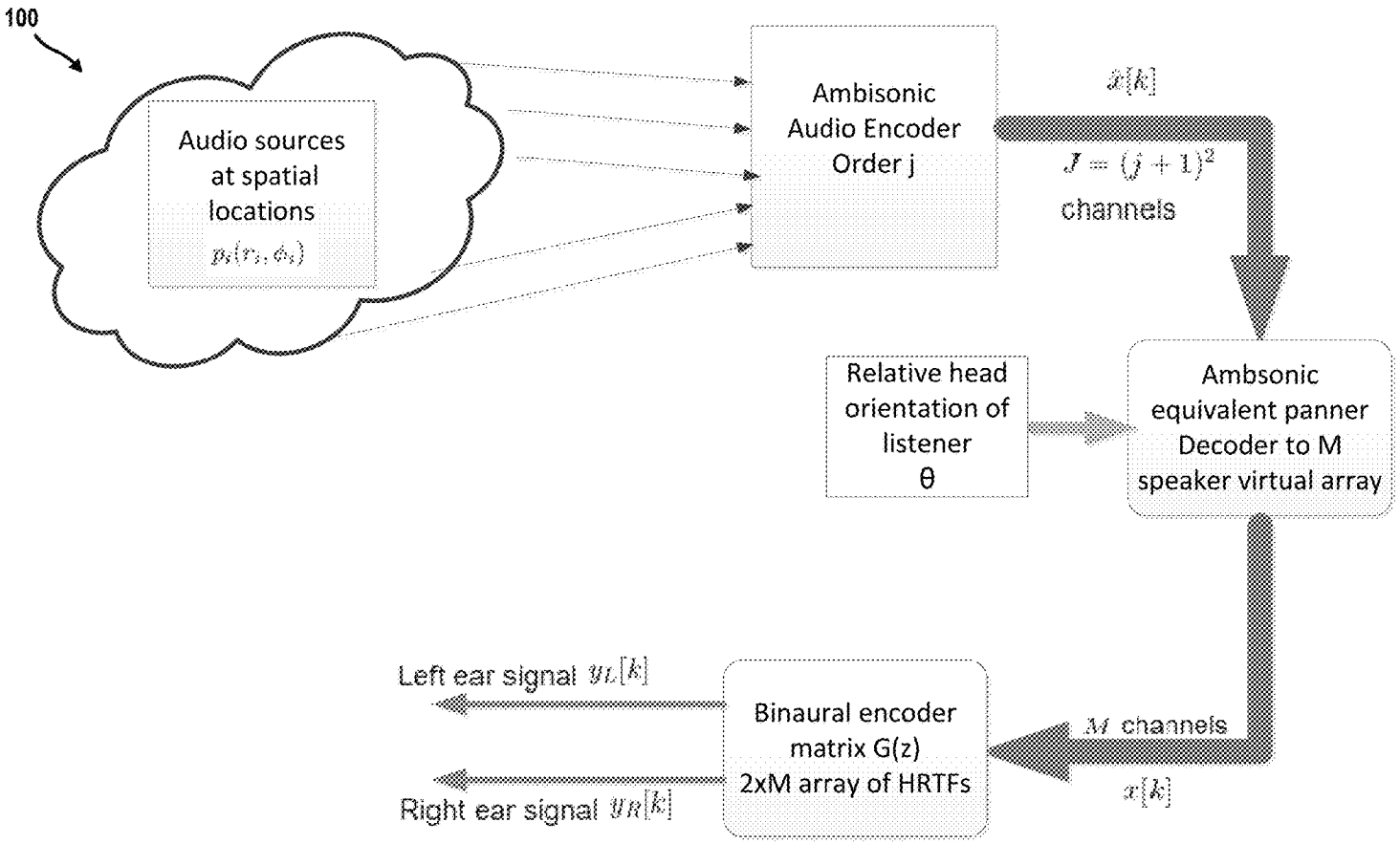
FIG. 1 is a block diagram illustrating an example system for head-tracked, Ambisonic encoded virtual loudspeaker based binaural audio according to one or more embodiments described herein.

The headings provided herein are for convenience only and do not necessarily affect the scope or meaning of what is claimed in the present disclosure.

In the drawings, the same reference numerals and any acronyms identify elements or acts with the same or similar structure or functionality for ease of understanding and convenience. The drawings will be described in detail in the course of the following Detailed Description.

DETAILED DESCRIPTION

Various examples and embodiments of the methods and systems of the present disclosure will now be described. The following description provides specific details for a thorough understanding and enabling description of these examples. One skilled in the relevant art will understand, however, that one or more embodiments described herein may be practiced without many of these details. Likewise, one skilled in the relevant art will also understand that one or more embodiments of the present disclosure can include other features not described in detail herein. Additionally, some well-known structures or functions may not be shown or described in detail below, so as to avoid unnecessarily obscuring the relevant description.

The methods and systems of the present disclosure address the computational complexities of the binaural rendering process mentioned above. For example, one or more Embodiments of the present disclosure relate to a method and system for reducing the number of arithmetic operations required to implement the 2M filter functions.

Introduction

FIG. 1 is an example system 100 that shows how the final stage of a spatial audio player (ignoring, for purposes of the present example, any environmental effects processing) takes multi-channel feeds to an array of virtual loudspeakers and encodes them into a pair of signals for playing over headphones. As shown, the final M-channel to 2-channel conversion is done using M individual 1-to-2 encoders, where each encoder is a pair of Left/Right ear Head Related Transfer Functions (HRTFs). So in the system description the operator G(z) is a matrix $$G(z) = \begin{bmatrix} G_{11}(z) & \dots & G_{1M}(z) \\ G_{21}(z) & \dots & G_{2M}(z) \end{bmatrix}$$

Each subsystem is usually the transfer function associated with the impulse response measured from a loudspeaker location to the left/right ear. As will be described in greater detail below, the methods and systems of the present disclosure provide a way to reduce the order of each subsystem through use of a process for Finite Impulse Response (FIR) to Infinite Impulse Response (IIR) conversion. A conventional approach to this challenge is to take each subsystem as a Single Input Single Output (SISO) system in isolation and simplify its structure. The following examines this conventional approach and also investigates how greater efficiencies can be achieved by operating on the whole system as an M-input and 2-output Multi Input Multi Output (MIMO) system.

While some existing techniques touch on MIMO models of HRTF systems, none address their use in Ambisonic based virtual speaker systems, as in the present disclosure. The basis of the system order reduction described in the present disclosure is based on a metric known as the Hankel norm. Since this metric is not widely known or well-understood, the following attempts to explain what the metric measures and why it has practical importance to acoustic system responses.

HRIR/HRTF Structure

The impulse responses between a sound source and the left and right ears of a listener are referred to as head related impulse responses (HRIRs) and as HRTFs when transformed to the frequency domain. These response functions contain the essential direction cues for the listener's perception of the location of the sound source. The signal processing to create virtual auditory displays use these functions as filters in the synthesis of spatially accurate sound sources. In VR applications, user view tracking requires that the audio synthesis be performed as efficiently as possible since, for example, (i) processing resources are limited, and (ii) low latency is often a requirement.

The signal transmission through the HRIR/HRTF, g, can be written for input x[k] and output y[k] as (for ease, the following will treat outputs for k>N) with $g=[g_0, g_1, g_2, \dots, g_{N-1}]$, Taking Z-Transform $$y[k] = \sum_{n=0}^{N-1} g_n x[k-n] \tag{1}$$

$$Y(z)=G(z)X(z) \tag{2}$$

$$G(z)=[g_0+g_1z^{-1}+g_2z^{-2}+\dots+g_{N-1}z^{N-1}] \tag{3}$$

Here, an N-point HRIR for the left (L) or right (R) ear is presented as a z-domain transfer function. The first $n_{L/R}$ sample values of a HRIR are approximately zero because of the transport delay from the source location to the L/R ear. The difference $n_L - n_R$ contributes to the Interaural Time Delay (ITD), which is a significant binaural cue to the direction to the source. From this point on, G(z) will refer to either HRTF, and the subscripts L and R are used only when describing differential properties.

Approximation of a FIR by a Lower Order IIR Structure

Introduction to the Hankel Norm

The following description seeks to replace G(z) by an alternative system $\hat{G}(z)$ which offers an advantage such as, for example, a lower computational load and is a "good" approximation to G(z) as measured by some metric $\|G(z)-\hat{G}(z)\|$ having y=Gx and $\hat{y}=\hat{G}x$. A useful metric of the difference is the $H_\infty$ norm of the error system given by $$\|G-\hat{G}\|_\infty = \sup_{x\varepsilon L_2} \frac{\|y-\hat{y}\|_2}{\|x\|_2} \tag{4}$$

This energy ratio gives as a norm the maximum energy in the difference for the minimum energy in the signal driving the systems. Hence, for the approximation error to be small this suggests to delete those modes that transfer least energy from input x to output y. It is useful to see that the $H_\infty$ norm of the error has the practical relevance of being equal to $$\|G-\hat{G}\|_\infty = \sup_\omega \left|G(\exp(j\omega)) - \hat{G}(\exp(j\omega))\right| \tag{5}$$

This shows that the $H_\infty$ norm is the peak of the Bode magnitude plot of the error.

The challenge, however, is that it is difficult to characterize the relationship between this norm and the system modes. Instead, the following will examine the use of the Hankel norm of the error since this has useful relationships to the system characteristics and is readily shown to provide an upper bound on the $H_\infty$ norm.

The Hankel norm of a system is the induced gain of a system for an operator called the Hankel operator $\Phi_G$, which is defined by the convolution like relationship $$\Phi_G[x[k]] = y[k] = \sum_{n=-\infty}^{-1} g[k-n]x[n] \tag{6}$$

It should be noted that by taking k=0 as time "now", this operator $\Phi_G$ determines how an input sequence x[k] applied from $-\infty$ to k=−1 will subsequently appear at the output of the system.

The Hankel norm induced by $\Phi_G$ is defined as $$\|G\|_H = \sup_{x\in L_2[-\infty,-1]} \frac{\sum_{k=0}^{\infty} y^2[k]}{\sum_{k=-\infty}^{-1} x^2[k]} \tag{7}$$

It should also be understood that the Hankel norm represents a maximizing of the future energy recoverable at the system output while minimizing the historic energy input to the system. Or, put another way, the future output energy resulting from any input is at most the Hankel norm times the energy of the input, assuming the future input is zero.

State Space System Representation and the Hankel Norm

It can be seen from the above description that the Hankel norm provides a useful measure of the energy transmission through a system. However, to understand how the norm is related to system order and its reduction it is necessary to characterize the internal dynamics of the system as modeled by its state-space representation. The representational connection between the state-space model of a Linear-Shift-Invariant (LSI) system and its transfer function is well known. With an $n^{th}$ order Single-Input-Single-Output (SISO) system described by the transfer function $$\frac{Y(z)}{X(z)} = G(z) = \frac{\alpha_0 + \alpha_1 z^{-1} + \ldots + \alpha_{n-1} z^{n-1}}{1 + \beta_{-1} z^{-1} + \ldots + \beta_{n-1} z^{n-1}}, \tag{8}$$

then for $w[k]\varepsilon\mathfrak{R}^{n-1}$, and with $A\varepsilon\mathfrak{R}^{(n-1)\times(n-1)}$, $B\varepsilon\mathfrak{R}^{(n-1)\times 1}$, $C\varepsilon\mathfrak{R}^{1\times(n-1)}$, and $D\varepsilon\mathfrak{R}$, this system can be described by the state-space model S:[A,B,C,D]:

$$w[k+1]=Aw[k]+Bx[k]$$

$$y[k]=Cw[k]+Dx[k] \tag{9}$$

The z-transform of this system is $$zW(z)=AW(z)+BX(z)$$

$$Y(z)=CW(z)+DX(z)$$

Giving $$Y(z)=[C(zI-A)^{-1}B+D]X(z)=G(z)X(z) \tag{10}$$

It should be noted that the system matrices [A, B, C, D] are not unique and an alternative state-space model may be obtained in terms of, for example, v[k] through the following similarity transformation: for an invertible matrix $T\varepsilon\mathfrak{R}^{(n-1)\times(n-1)}$, Tv=w, giving $\hat{A}=T^{-1}AT$, $\hat{B}=T^{-1}B$, $\hat{C}=CT$, and $\hat{D}=D$. The state-space model S:[$\hat{A}$, $\hat{B}$, $\hat{C}$, $\hat{D}$] has the same transfer function G(z).

It should be understood that for purposes of the present example, it is assumed G(z) is a stable system and, equivalently, S is stable, meaning that the eigenvalues of $A=\lambda(A)$ all lie on the unit disk $|\lambda|<1$.

The Hankel norm of G(z) can now be described in terms of the energy stored in w[0] as a consequence of an input sequence x[k] for $-\infty<k\leq-1$, and then how much of this energy will be delivered to the output y[k] for $k\geq 0$.

In order to describe the internal energy of S it is necessary to introduce two system characteristics:

(i) The reachability (controllability) Gramian $P=\Sigma_{k=0}^{\infty}A^kBB^T(A^T)^k$, and (ii) The observability Gramian $Q=\Sigma_{k=0}^{\infty}(A^T)^kC^TCA^k$.

Since A is stable, the two above summations converge, and it is straightforward to show that P is symmetric and positive definite if, and only if, the pair (A, B) is controllable (which means that, starting from an w[0], a sequence x[k], k>0 can be found to drive the system to any arbitrary state w*). Also, Q is symmetric and positive definite if, and only if, the pair (A, C) is observable (which means that the state of the system at any time j can be determined from the system outputs y[k] for k>j).

It is straightforward to show that P and Q can be obtained as solutions to the Lyapunov equations $$APA^T+BB^T-P=0$$

and $$A^TQA+C^TC-Q=0.$$

The observation energy of the state is the energy in the trajectory $y[k]\geq 0$ with $w[0]=w_0$ and $x[k]=0$ for $k\geq 0$. It is straightforward to show that $$y[k]=CA^kw_0 \text{ and } \|y\|_2^2=\sum_{k=0}^{\infty} w_0^T(A^T)^kC^TCA^kw_0=w_0^TQw_0$$

The minimum control energy problem is defined as what is the minimum energy:

$$J(x)=\sum_{k=-\infty}^{-1} x^T[k]x[k] \text{ that drives the system to } w[0]=w_0$$

This is a standard problem in optimal control and it has the solution $$x_{opt}[k]=B^T(A^T)^{-(1+k)}P^{-1}w_0 \text{ for } k<0$$

given $J(x_{opt})=w_0{}^TP^{-1}w_0$.

In view of the above, it is now possible to explicitly relate the Hankel norm of a system G(z), or equivalently S:[A,B,C,D], to Q and P Gramians as $$\|G\|_H=sup_{w0}\frac{w_0^TQw_0}{w_0^TP^{-1}w_0} \tag{11}$$

Balanced State Space System Representations

It should now be understood that, for HRTF systems, it is possible to compute an appropriate similarity transformation, T, to obtain a system realization S:[$\hat{A}$, $\hat{B}$, $\hat{C}$, $\hat{D}$] that gives equal reachability and observability Gramians that are a diagonal matrix $\Sigma$ $$Q=P=\Sigma=\text{diag}(\sigma_1,\ldots,\sigma_{n-1}) \text{ with } \sigma_1\geq\sigma_2\geq\ldots\geq\sigma_{n-1}>0.$$

In accordance with at least one embodiment of the present disclosure, obtaining a balanced state space system representation may include the following:

(i) Starting with G(z) it is determined (e.g., recognized) as a state-space system S:[A,B,C,D].

(ii) For S, the Gramians are solved to get P and Q.

(iii) Linear algebra is used to give $\Sigma=\text{diag}(\sigma_1,\ldots,\sigma_{n-1})=\sqrt{\lambda(PQ)}$.

(iv) Factorization $P=M^TM$ and $MQM^T=W^T\Sigma^2W$ where W is unitary, gives M and W such that $T=M^TW\Sigma^{-1/2}$ for which $\hat{P}=T^TPT=\Sigma=\hat{Q}=T^{-1}Q(T^{-1})^T$ (v) The T from (iv) may be used to get a new representation of the system as $\hat{A}=T^{-1}AT$, $\hat{B}=T^{-1}B$, $\hat{C}=CT$, $\hat{D}=D$.

(vi) In the representation obtained in (v) there are balanced states. In order words, the minimum energy to bring the system to the state $(0,0,\ldots,1,0,\ldots 0)^T$ with a 1 in position i is $\sigma_i^{-1}$, and if the system is released at this state then the energy recovered at the output is $\sigma_i$.

(vii) In this balanced model the states are ordered in terms of their importance to the transmission of energy from signal input to output. Thus, in this structure a truncation of the states and equivalently a reduction of the order of G(z) will remove states in terms of their importance to the transmission of energy.

Example of Balanced State Space System Based Order Reduction

The following will examine the generation of a state-space model of an FIR structure and its order reduction using the balanced system representation described above.

The present example proceeds by studying a 26-point FIR filter g[k]

$$g=\begin{matrix}[0.268 & 0.268 & -0.101 & -0.240 & -0.040 & 0.076 & 0.017 & 0.010 & 0.049 & 0.008\\ -0.039 & -0.016 & 0.003 & -0.008 & -0.001 & 0.015 & 0.007 & -0.004 & -0.001 & 0.000\\ -0.003 & -0.002 & 0.001 & 0.000 & -1.528 & 0.000] & & & & \end{matrix}$$

with transfer function $$G(z)=[g_0+g_1z^{-1}+\ldots g_{25}z^{-25}].$$

A 25th-order state-space model is created with $$A=\begin{pmatrix}0&0&.&.&0\\1&0&.&.&0\\0&1&0&.&0\\.&.&.&.&.\\0&.&.&1&0\end{pmatrix}\quad B=\begin{pmatrix}1\\0\\.\\.\\0\end{pmatrix}\quad C=(g_1\ \ldots\ g_{25})\quad D=(g_0)$$

Figure 2:
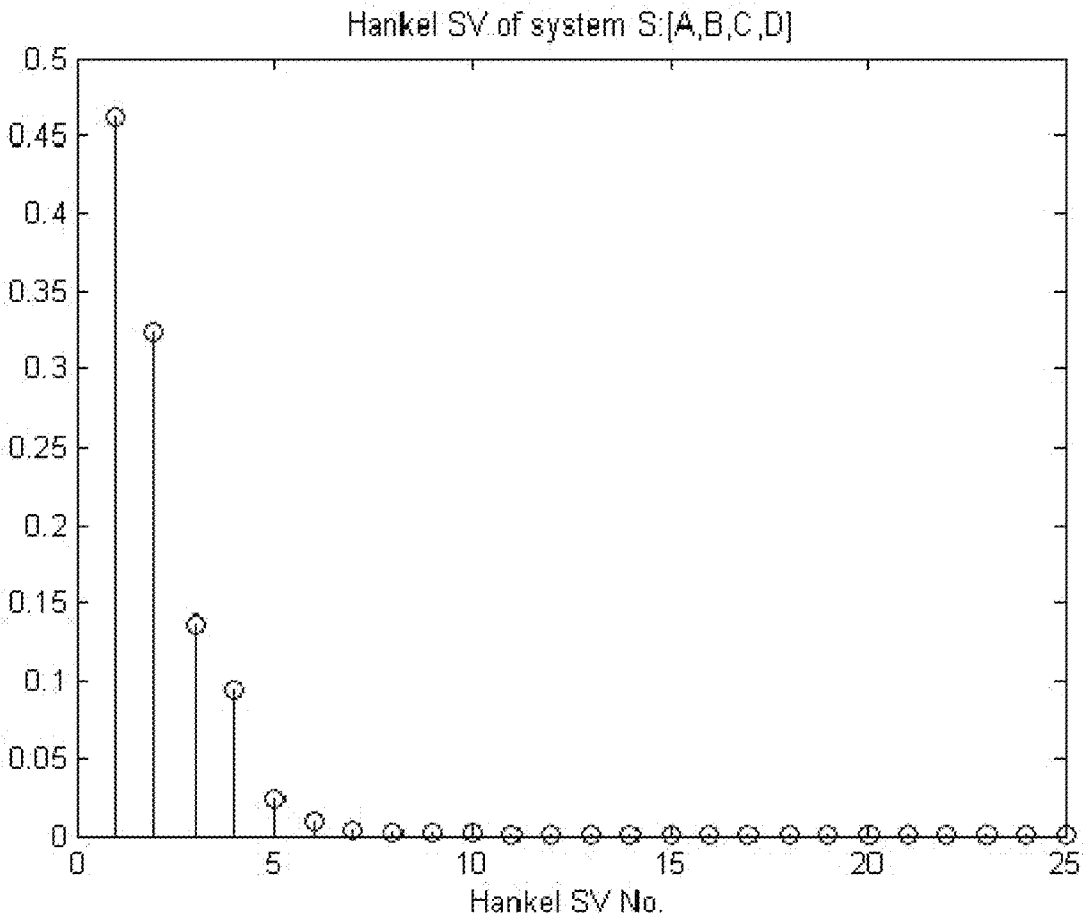
FIG. 2 is a graphical representation of an example state space system that has Hankel singular values according to one or more embodiments described herein.

As illustrated in FIG. 2, the system S:[A,B,C,D] has Hankel singular values (SVs).

S is transformed to S:[$\hat{A}=T^{-1}AT$, $\hat{B}=T^{-1}B$, $\hat{C}=CT$, $\hat{D}=D$]. From the profile of Hankel SVs (e.g., as illustrated in FIG. 2), a 6th-order approximation to S may be obtained. The system is thus partitioned as follows:

$$\begin{pmatrix}\hat{A}_{6\times6}:\hat{A}_{6\times18}\\ \hat{A}_{18\times6}:\hat{A}_{6\times6}\end{pmatrix}\begin{pmatrix}\hat{B}_{6\times1}\\ \hat{B}_{18\times1}\end{pmatrix}\ (\hat{C}_{1\times6}:\hat{C}_{1\times18})\ (\hat{D})$$

The reduced order system is $S_6$:[$\hat{A}_{6\times6}$, $\hat{B}_{6\times1}$, $\hat{C}_{1\times6}$, $\hat{D}$], which gives the reduced order transfer function $$G_6(z)=\hat{C}_{1\times6}(zI-\hat{A}_{6\times6})^{-1}\hat{B}_{6\times1}+\hat{D}$$

$$G_6(z)=\frac{(0.27-0.1z-1-0.04z-2-0.01z-3+0.05z-4+0.04z^{-5}-0.02z^{-6})}{(1-1.32z-1+1.55z-2-1.18z-3+0.92z-4-0.34z^{-5}+0.11z^{-6})}$$

Figure 3:
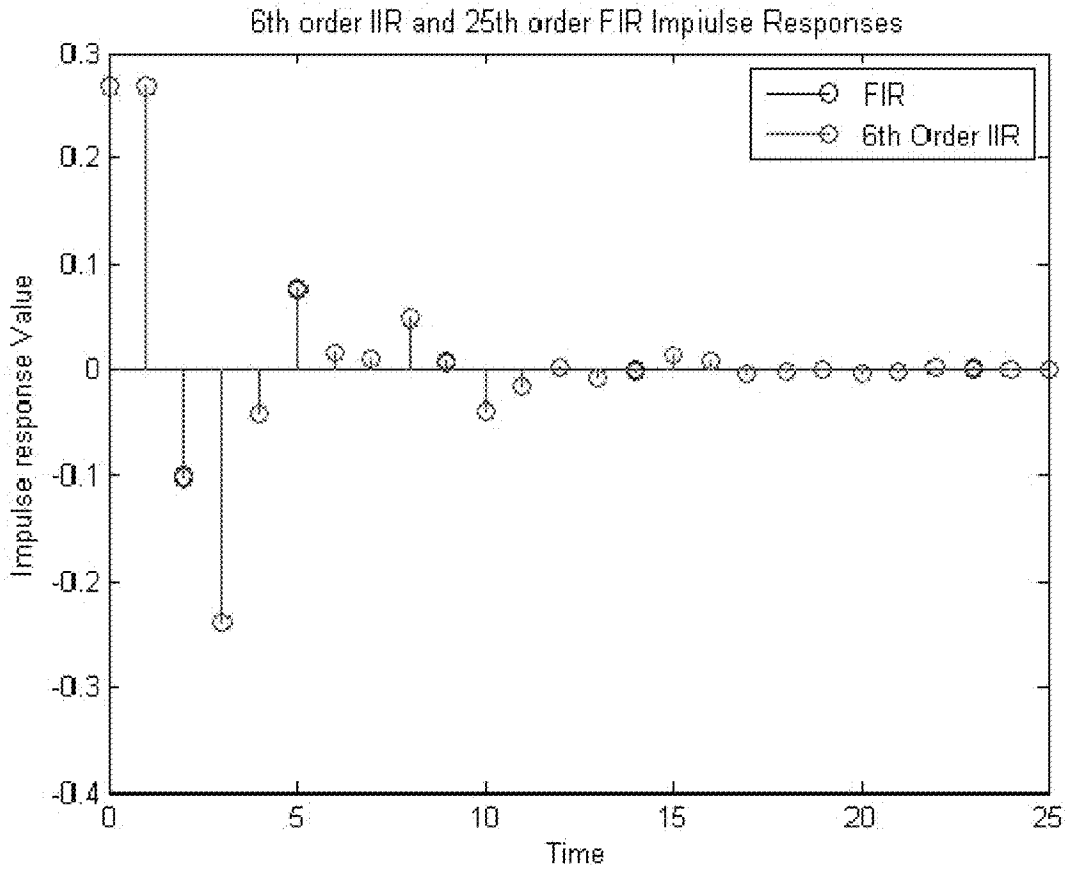
FIG. 3 is a graphical representation illustrating impulse responses of a 25th-order Finite Impulse Response approximation and a 6th-order Infinite Impulse Response approximation for an example state-space system according to one or more embodiments described herein.

For comparison, the impulse responses of the original FIR G(z) and the 6th order IIR approximation are illustrated in FIG. 3. The plot shown in FIG. 3 reveals an almost lossless match.

Figure 4:
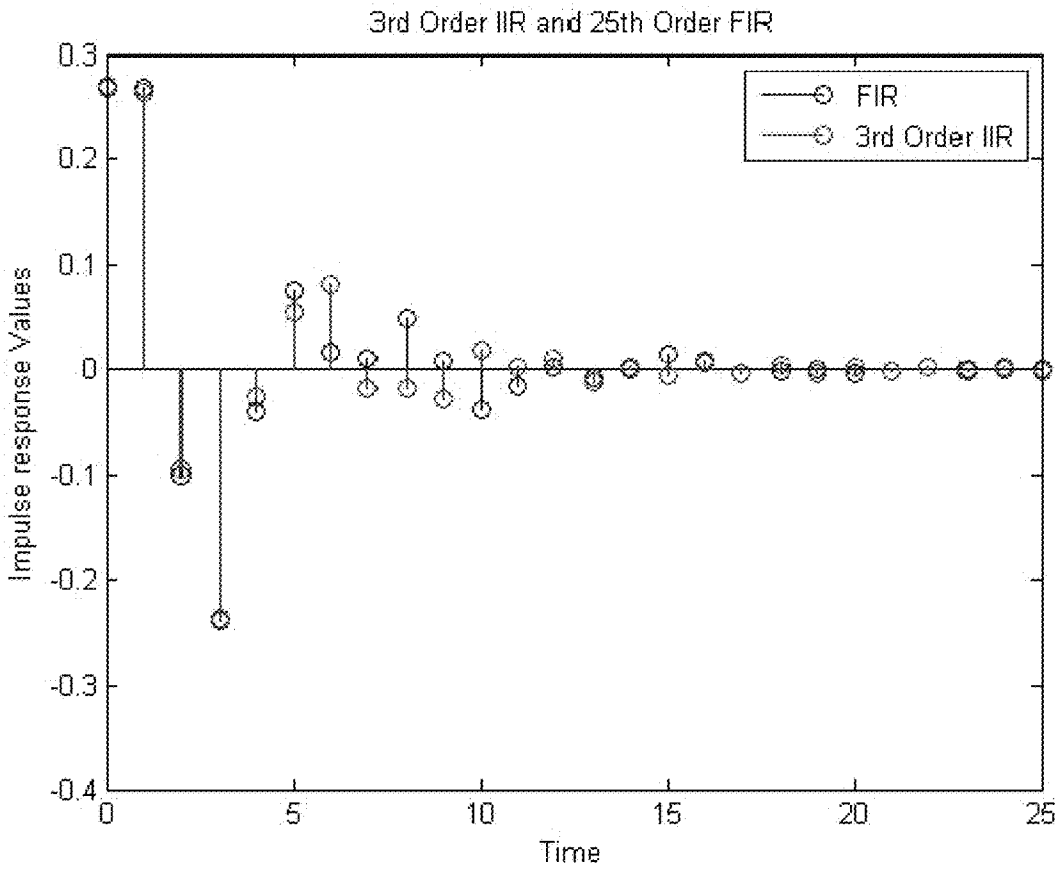
FIG. 4 is a graphical representation illustrating impulse responses of a 25th-order Finite Impulse Response approximation and a 3rd-order Infinite Impulse Response approximation for an example state-space system according to one or more embodiments described herein.

Also for comparison, the impulse responses of the original FIR G(z) and the 3rd order IIR approximation are illustrated in FIG. 4.

Balanced Approximation of HRIRs

Virtual Speaker Array and HRIR Set

Figure 5:
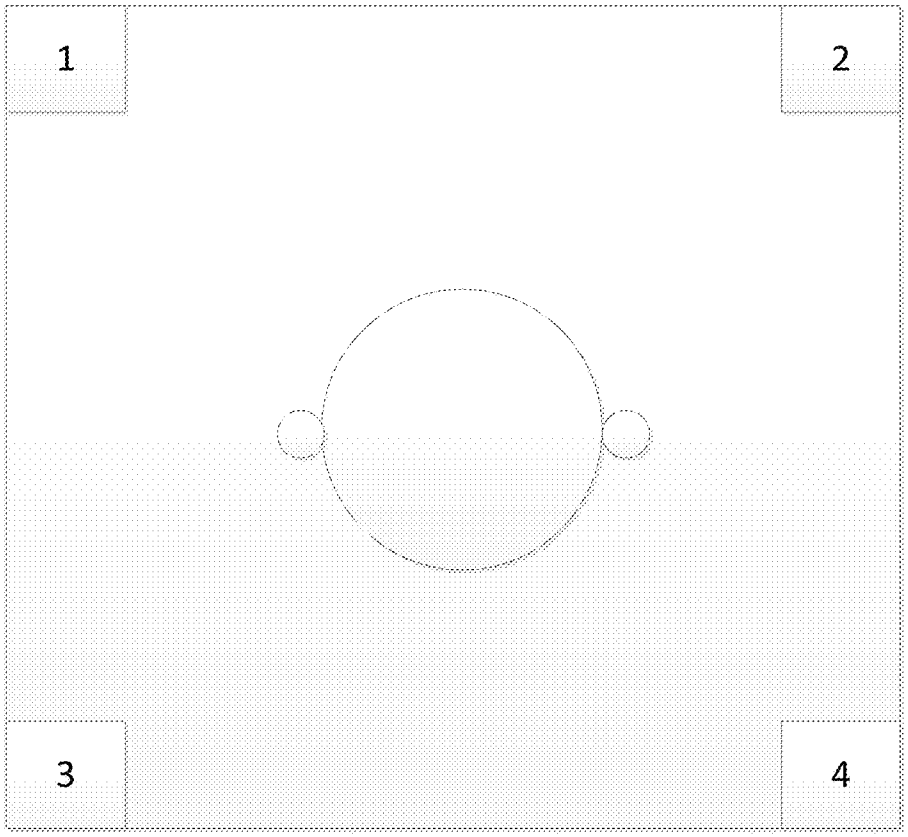
FIG. 5 is a block diagram illustrating an example arrangement of loudspeakers in relation to a user.

The following describes an example scenario based on a simple square arrangement of loudspeakers, as illustrated in FIG. 5, with the outputs mixed down to binaural using the HRIRs of Subject 15 of the CIPIC set. These are 200 point HRIRs sampled at 44.1 kHz and the set contains a range of associated data that includes measures of the Interaural Time Difference, ITD, between the each pair of HRIRs. The transfer function G(z) of a HRIR (e.g., equation (3) above) will have a number of leading coefficients $[g_0, \ldots, g_m]$ that are zero and account for an onset delay in each response, giving G(z) as shown in equation (12) below. The difference between the onset times of the left and right of a pair of HRIRs largely determines their contribution to the ITD. The form of a typical left HRTF is given in equation (12) and the right HRTF has a similar form:

$$G_L(z)=z^{-m_L}\grave{G}_L(z) \tag{12}$$

The ITD is given by $ITD=|m_L-m_R|$ and this is provided for each HRIR pair in the CIPIC database. The excess phase associated with the onset delay means that each G(z) is non-minimum phase and it has also been shown that the main part of the HRTF $\grave{G}(z)$ will also be non-minimum phase. But it has also been shown that listeners cannot distinguish the filter effect of $\grave{G}(z)$ from its minimum phase version which is denoted as H(z). Thus, in the present example of FIR to IIR approximation, the original FIRs G(z) by their minimum phase equivalents H(z), an action that removes the onset delay from each HRIR.

Single-Input-Single-Output IIR Approximation using Balanced Realization

In accordance with at least one embodiment, single-input-single-output (SISO) IIR approximation using balanced realization is a straightforward process that includes, for example:

(i) Read HRIR(l/r,1:200) for each node.

(iv) Use the balanced reduction method described above to obtain a reduced order version of S of dimension rr. For example, $S_{rr}$: $[A_{rr}, B_{rr}, C_{rr}, D_{rr}]$.

(iii) Build a SISO state-space representation of HHRIR (l/r,1:200) as S:[A,B,C,D]. This will be a 199 dimension state-space.

(iv) Use the balanced reduction method described above to obtain a reduced order version of S of dimension rr. For example, $S_{rr}$:$[A_{rr}, B_{rr}, C_{rr}, D_{rr}]$.

The cepstrum of that HRIR can have causal samples taken at positive times and non-causal samples taken at negative times. Thus, for each of the non-causal samples of the cepstrum, a phase minimization operation can be performed by adding that non-causal sample taken at a negative time to a causal sample of the cepstrum taken at the opposite of that negative time. A minimum-phase HRIR can be generated by setting each of the non-causal samples of the cepstrum to zero after performing the phase minimization operation for each of the non-causal samples of the cepstrum.

Example results from approximating the left and right HRIRs for each node by 12th order (e.g., for rr=12), are presented in the plots shown in FIGS. 10-17.

FIGS. 10-17 are graphical representations illustrating Frequency Responses of Subject 15 CIPIC [+/−45 deg, +/−135 deg], Fs=44100 Hz, Original IIR 200 point, IIR approximation 12th order.

The results plotted in FIGS. 10-17 show that the 12th order IIR approximations give very close matches to the frequency responses, in both magnitude and phase, of the original HRTFs. This means that rather than implementing 8×200Pt FIRs, the HRIR computation can be implemented as 8×[{6 biquad} IIR sections+ITD delay line].

Multi-Input-Multi-Output IIR Approximation using Balanced Realization

In accordance with at least one embodiment, multi-input-multi-output (MIMO) IIR approximation using balanced realization is a process that may be initiated in the same manner as for the SISO, described above. For example, the process may include:

(i) Read HRIR(l/r,1:200) for each node.

(ii) Obtain the minimum phase equivalent using cepstrum as described above; giving for each node HHRIR(l/r,1:200).

(iii) Build a SISO state-space representation of each HHRIR(l/r,1:200) as $S_{ij}$:$[A_{ij}, B_{ij}, C_{ij}, D_{ij}]$ for i=1,2≡left/right and j=1,2,3,4≡Node 1,2,3,4. Each $S_{ij}$ will be a 199 dimension state-space system. Here, $A_{ij}\in\mathfrak{R}^{199\times199}$, $B_{ij}\in\mathfrak{R}^{199\times1}$, $C_{ij}\in\mathfrak{R}^{1\times199}$, and $D_{ij}\in\mathfrak{R}^{1\times1}$.

(iv) Build a composite MIMO system with an internal state-space of, for example, dimension 4×199=796, and with 4 inputs and 2 outputs. This system S:[A,B,C,D], where A,B,C,D is structured as:

$$A=\begin{bmatrix} A_1 & 0 & 0 & 0 \\ 0 & A_2 & 0 & 0 \\ 0 & 0 & A_3 & 0 \\ 0 & 0 & 0 & A_4 \end{bmatrix}\varepsilon R^{796\times796}$$

$$B=\begin{bmatrix} B_1 & 0 & 0 & 0 \\ 0 & B_2 & 0 & 0 \\ 0 & 0 & B_3 & 0 \\ 0 & 0 & 0 & B_4 \end{bmatrix}\varepsilon R^{796\times4}$$

$$C=\begin{bmatrix} C_{11} & C_{12} & C_{13} & C_{14} \\ C_{21} & C_{22} & C_{23} & C_{24} \end{bmatrix}\varepsilon R^{2\times796}$$

$$D=\begin{bmatrix} D_{11} & D_{12} & D_{13} & D_{14} \\ D_{21} & D_{22} & D_{23} & D_{24} \end{bmatrix}\varepsilon R^{2\times4}$$

This 796 dimension system can be reduced using the Balanced Reduction method described in accordance with one or more embodiments of the present disclosure.

Figure 6:
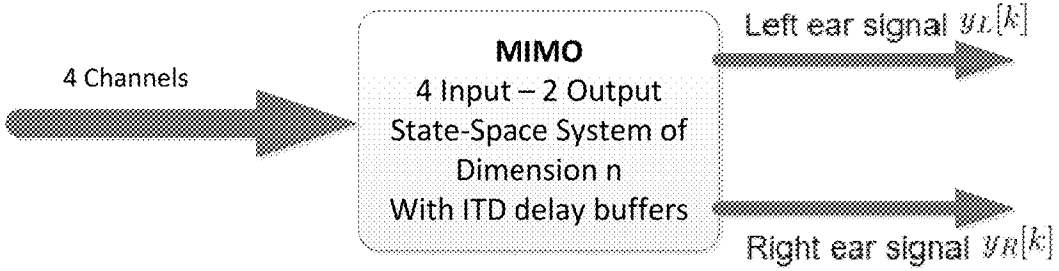
FIG. 6 is a block diagram illustrating an example binaural renderer system.

In at least the example implementation described above, each of the sub-systems $S_{ij}$ is reduced to a 30th order SISO system before the generation of S. This step makes S a 4×30=120 dimension system. This may then be reduced to, for example, a n=12, order 4 input, and 2 output system, similar to the one illustrated in FIG. 6.

As is described in greater detail below, the methods and systems of the present disclosure address the computational complexities of the binaural rendering process. For example, one or more embodiments of the present disclosure relate to a method and system for reducing the number of arithmetic operations required to implement the 2M filter functions.

Existing binaural rendering systems incorporate HRTF filter functions. These are usually implemented using the Finite Impulse Response (FIR) filter structure with some implementations using the Infinite Impulse Response (IIR) filter structure. The FIR approach uses a filter of length n, and requires n multiply and addition (MA) operations for each HRTF (e.g., 400) to deliver one output sample to each ear. That is, each binaural output requires n×2M MA operations. For example, in a typical binaural rendering system, n=400 may be used. The IIR approach described in the present disclosure uses a recursive structure of order m with m typically in the range of, for example, 12–25 (e.g., 15).

It should be appreciated that, to compare the computational load of the IIR to that of the FIR, one would have to take account of the numerator and denominator. For 2M SISO IIR each order m one would have almost 2m×2M MA (i.e., there would be 1 less Multiply). For a MIMO structure one would have [(m−1)×2M+2m] MA where the {+2m} accounts for the common recursive sections. Of course m in MIMO is greater than m in SISO.

Unlike existing approaches, in the methods and systems of the present disclosure, there are recursive parts that are common to, for example, all the left (respectively, right) ear HRTFs or other architectural arrangements such as all ipsilateral (respectively, contralateral) ear HRTF s.

The methods and systems of the present disclosure may be of particular importance to the rendering of binaural audio in Ambisonic audio systems. This is because Ambisonics delivers spatial audio in a manner that activates all the loudspeakers in the virtual array. Thus, as M increases, the saving of computational steps through use of the present techniques becomes of increased importance.

The final M-channel to 2-channel binaural rendering is conventionally done using m individual 1-to-2 encoders where each encoder is a pair of Left/Right ear Head Related Transfer Functions, (HRTFs). So the system description is the HRTF operator $$Y(z)=G(z)X(z)$$

here G(z) given by matrix $$G(z)=\begin{bmatrix} G_{11}(z) & \dots & G_{1M}(z) \\ G_{21}(z) & \dots & G_{2M}(z) \end{bmatrix}$$

With FIR filters each subsystem has the following form (with the leading $k^{ij}$ coefficients equal to zero in the non-minimum phase case {e.g., $g_0^{ij}:g_{k-1}^{ij}=0$}):

$$G_{ij}(z)=[g_0^{ij}+g_1^{ij}z^{-1}+g_2^{ij}z^{-2}+\dots+g_{N-1}^{ij}z^{N-1}]$$

In accordance with one or more embodiments of the present disclosure, G(z) may be approximated by a $n^{th}$-order MIMO state-space system S:[Â, B̂, Ĉ, D̂]. This gives the example MIMO binaural renderer (e.g., mixer) system illustrated in FIG. 7 (which, in accordance with at least one embodiment, may be used for 3D audio).

Figure 7:
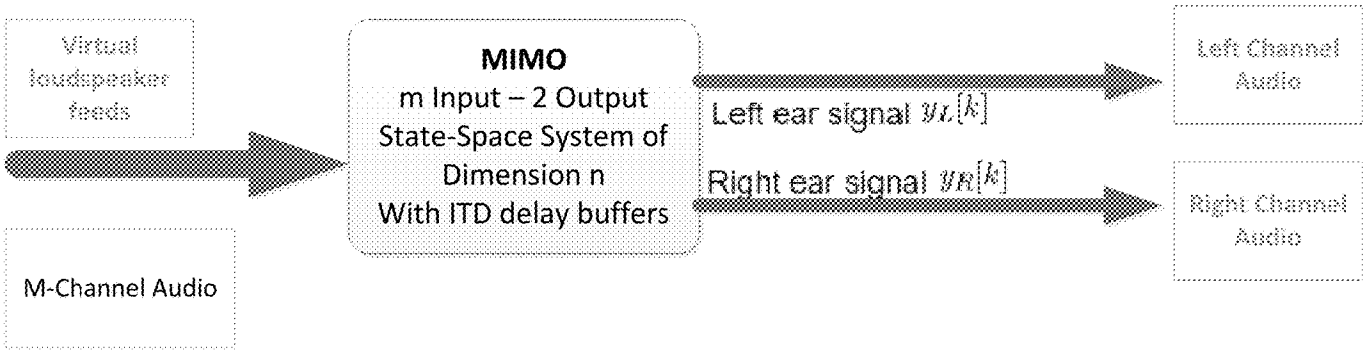
FIG. 7 is a block diagram illustrating an example MIMO binaural renderer system according to one or more embodiments described herein.

In FIG. 7, the ITD Unit subsystem is a set of pairs of delay lines where, per input channel, only one of the pair is a delay and the other is unity. Therefore, in the z-domain there is an input/output representation such as $$\Delta(z)=\begin{bmatrix} z^{-\delta_{11}} & \dots & z^{-\delta_{1M}} \\ z^{-\delta_{21}} & \dots & z^{-\delta_{2M}} \end{bmatrix}$$

Each pair ($\delta_{1k}$, $\delta_{2k}$) has the form (α,β) with α=0 when left ear ipsilateral to source, and β>0 is the ITD delay with vice versa when right ear ipsilateral.

The M Input to 2 Output MIMO system S:[Â, B̂, Ĉ, D̂], which has been reduced to order n using the Balanced Reduction method can be used to obtain a HRTF set which can be written as $$\grave{G}(z)=\{\hat{C}[zI-\hat{A}]^{-1}\hat{B}+\hat{D}\}\cdot\Delta(z)$$

Here the '.' denotes the Hadamard product. This transfer function matrix differs from G(z) above because now each subsystem has the same denominator. The subsystems are the BR form of the HRTF to the left/right ear [i=1≡left, i=2≡right] from virtual loudspeaker j and have the form $$\hat{G}_{ij}(z)=\frac{n_{ij}(z)}{d_{ij}(z)}=\frac{n_{ij}(z)}{d(z)} \text{ here } d(z)=d_{ij}(z)=\det\left[zI-\hat{A}\right] \text{ for all } ij$$

Figure 8:
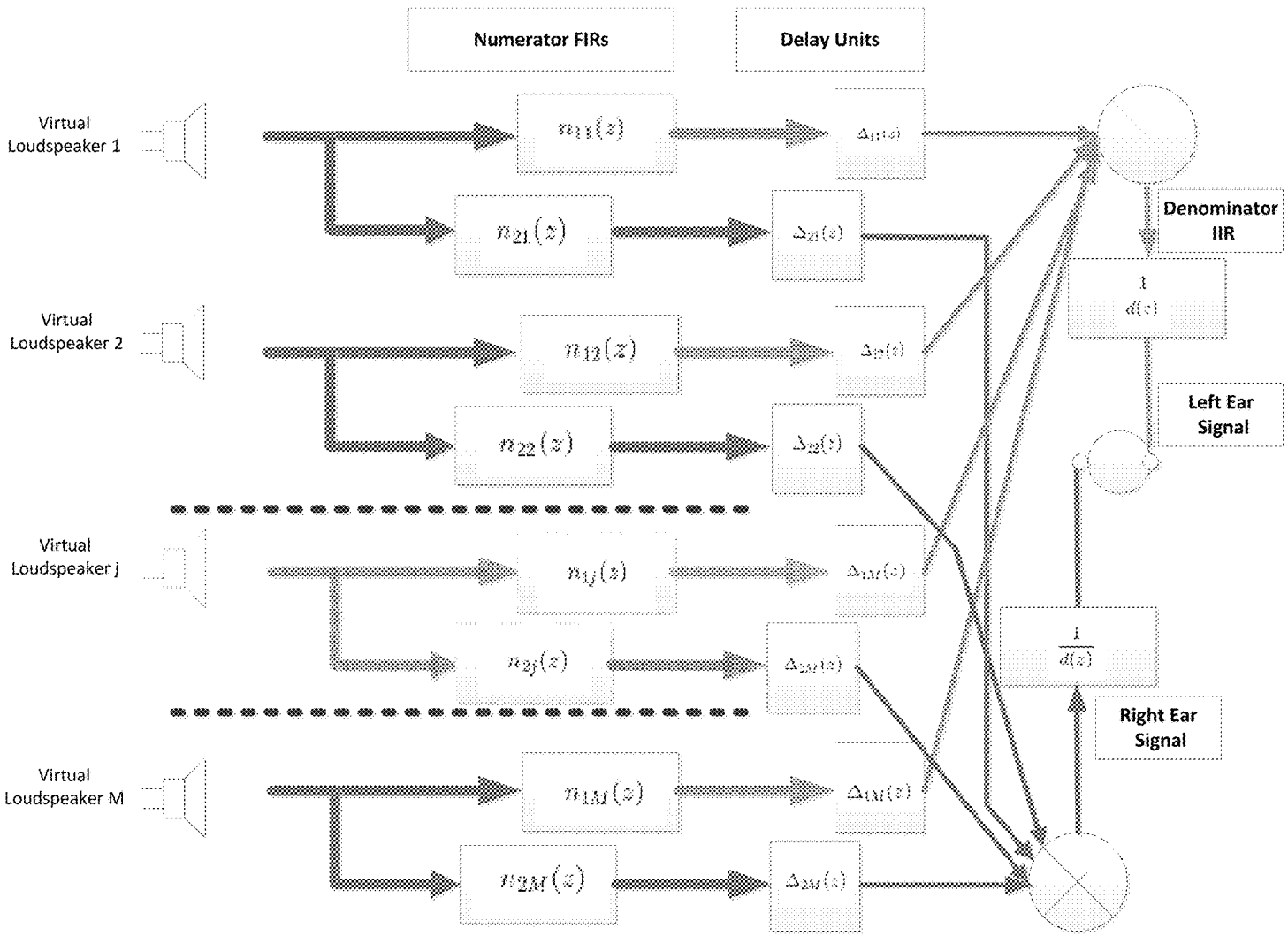
FIG. 8 is a block diagram illustrating an example binaural rendering system according to one or more embodiments described herein.

Therefore, if the Balanced Reduction to MIMO approach (as described above) is used to take original N-point FIR HRTFs and approximate them with a n-order {e.g., n=N/10}, then binaural rendering may be implemented as the system illustrated in FIG. 8.

It should be noted that, in accordance with at least one embodiment, the final IIR section as shown in FIG. 8 may be combined with room effects filtering.

In addition, it should be noted that this factorization into individual angle dependent FIR sections in cascade with a shared IIR section is consistent with experimental research results. Such experiments have demonstrated how HRIRs are amenable to approximate factorization.

Figure 9:
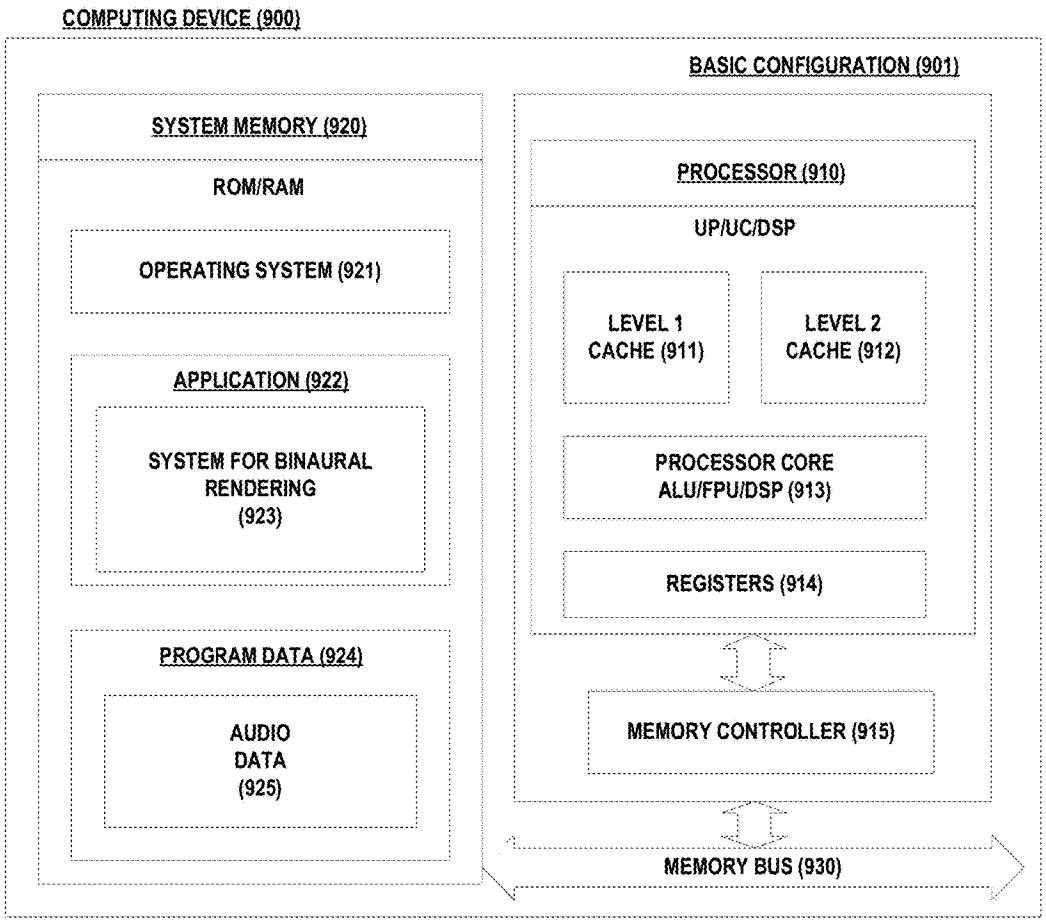
FIG. 9 is a block diagram illustrating an example computing device arranged for binaural rendering according to one or more embodiments described herein.
Figure 10:
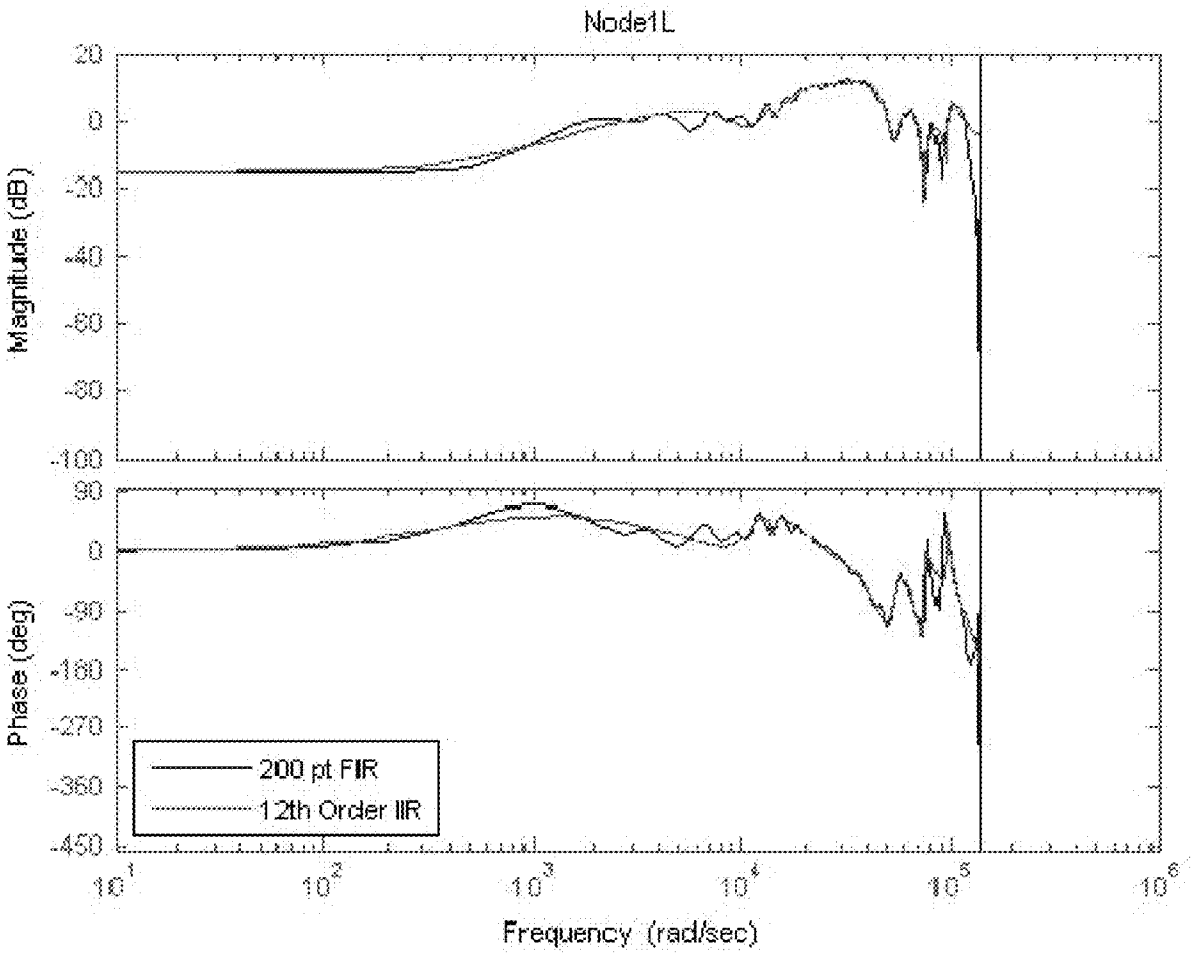
FIG. 10 is a graphical representation illustrating example results of a single-input-single-output (SISO) IIR approximation using balanced realization for a first left node according to one or more embodiments described herein.
Figure 11:
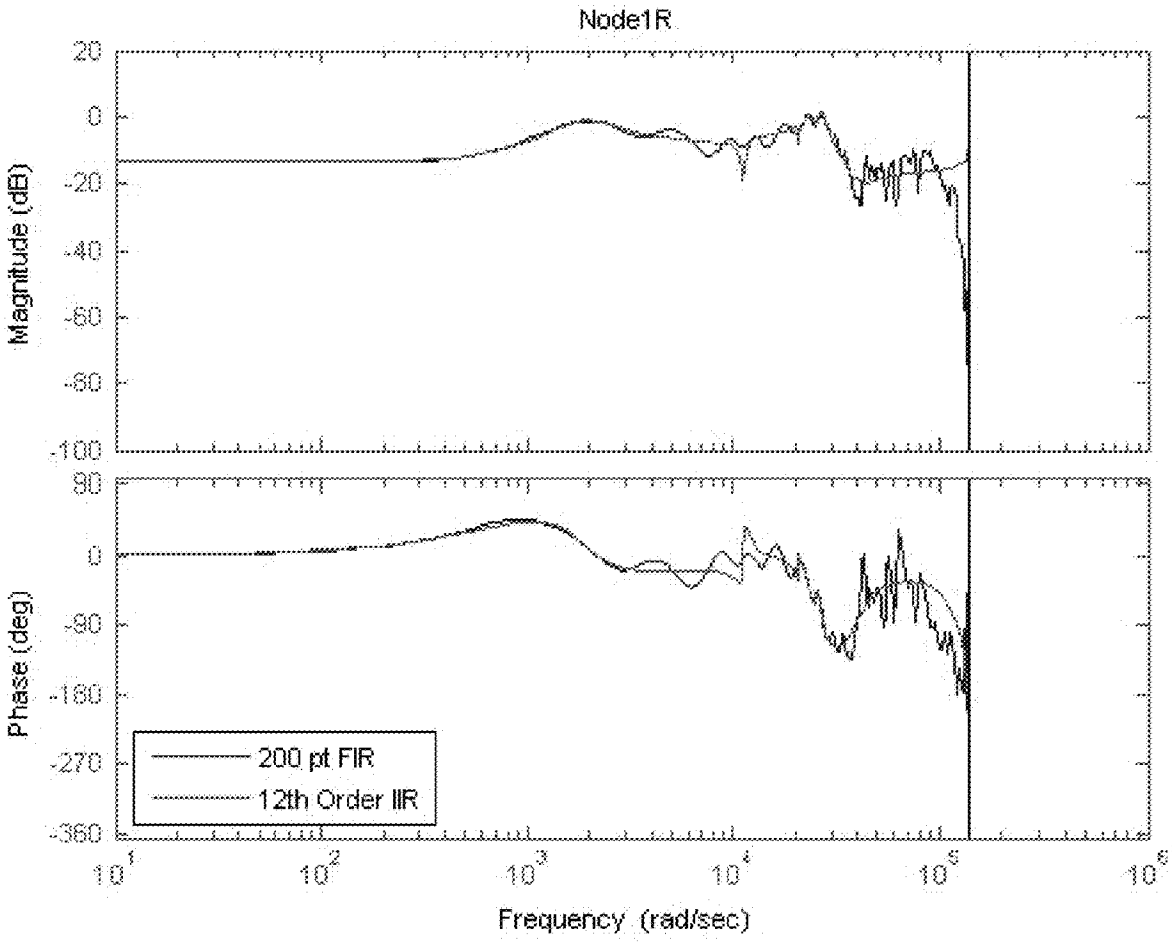
FIG. 11 is a graphical representation illustrating example results of a SISO IIR approximation using balanced realization for a first right node according to one or more embodiments described herein.
Figure 12:
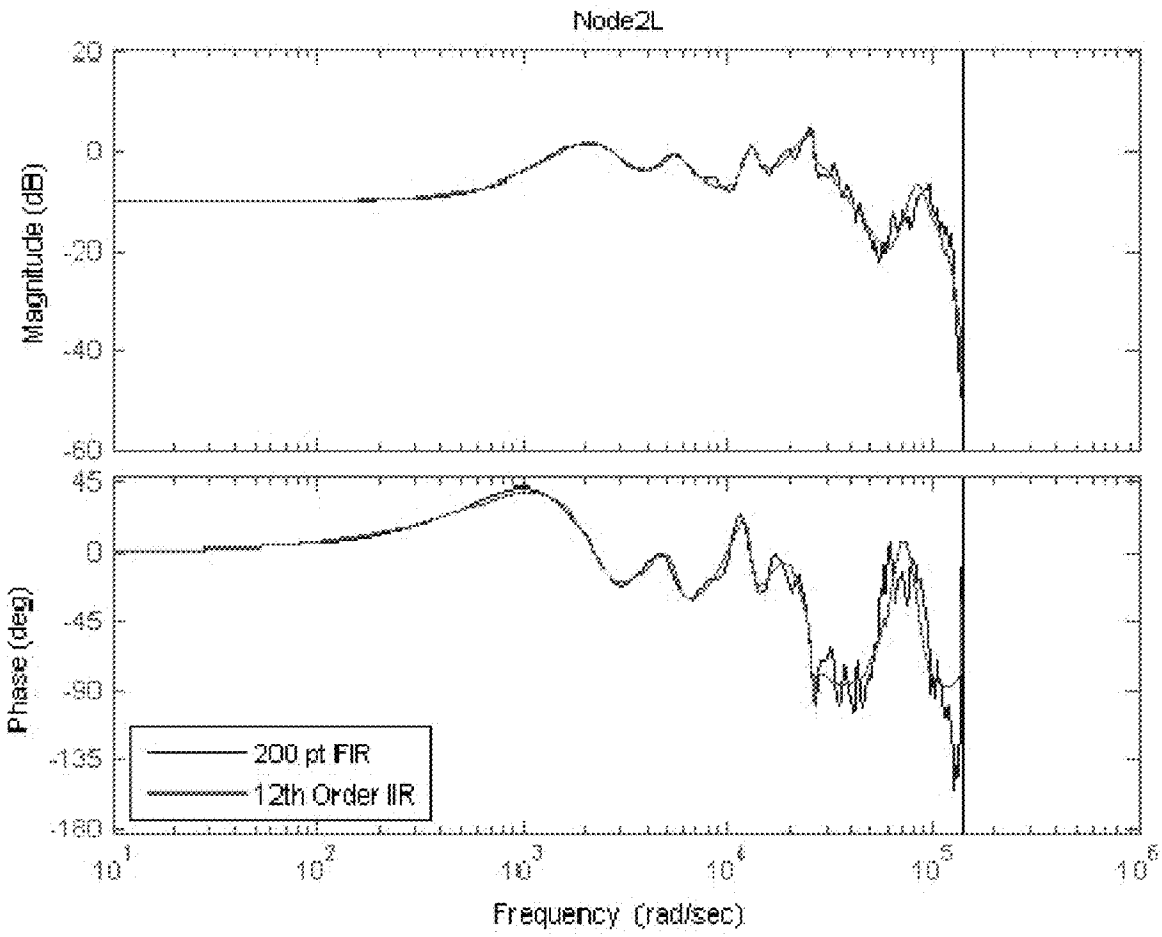
FIG. 12 is a graphical representation illustrating example results of a SISO IIR approximation using balanced realization for a second left node according to one or more embodiments described herein.
Figure 13:
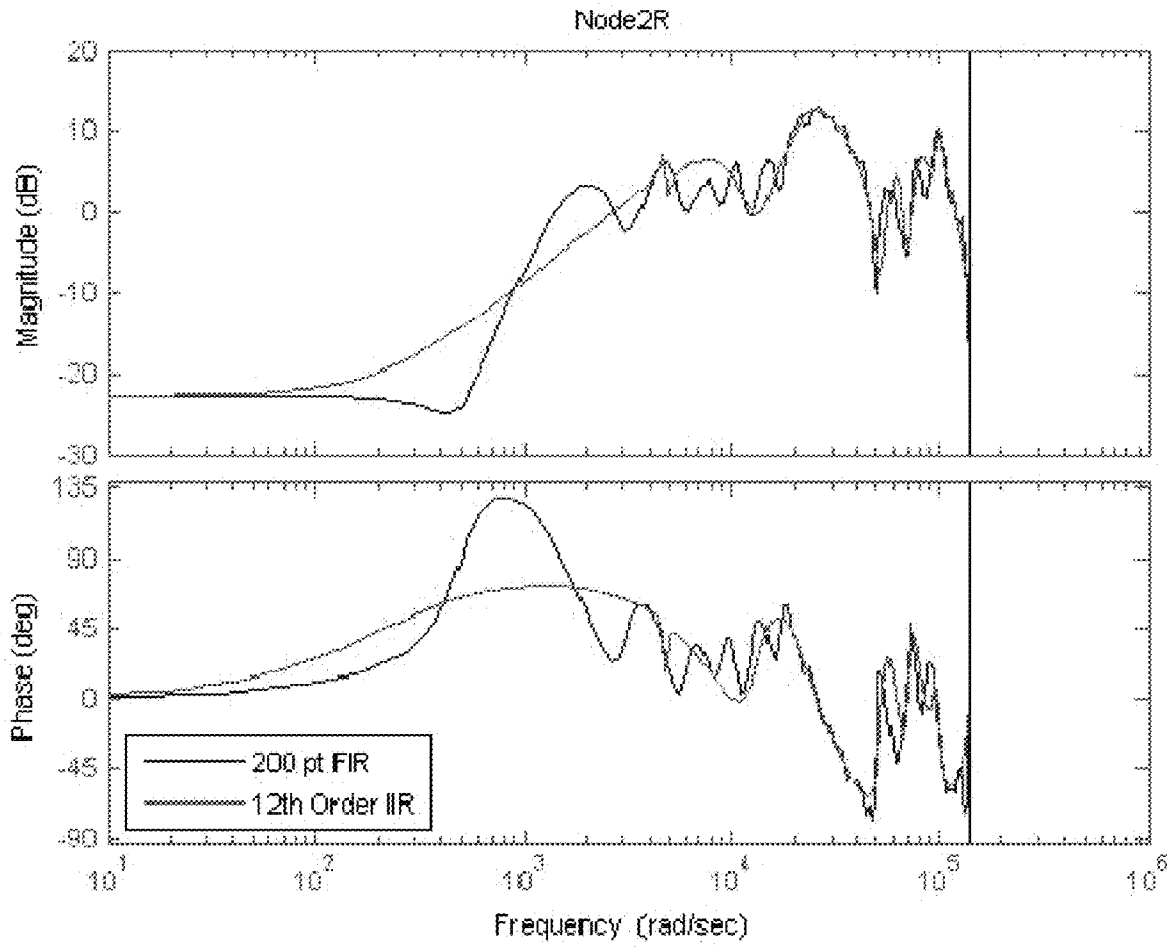
FIG. 13 is a graphical representation illustrating example results of a SISO IIR approximation using balanced realization for a second right node according to one or more embodiments described herein.
Figure 14:
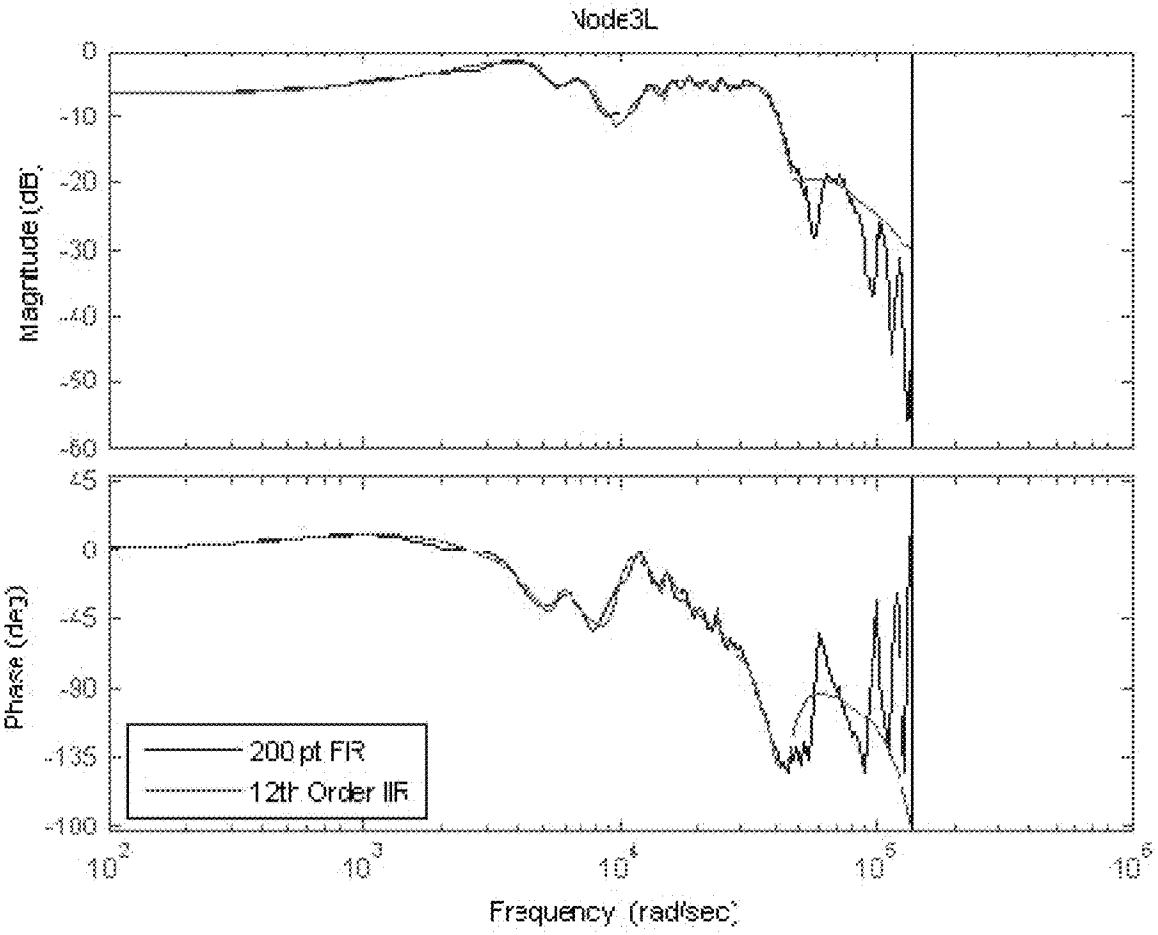
FIG. 14 is a graphical representation illustrating example results of a SISO IIR approximation using balanced realization for a third left node according to one or more embodiments described herein.
Figure 15:
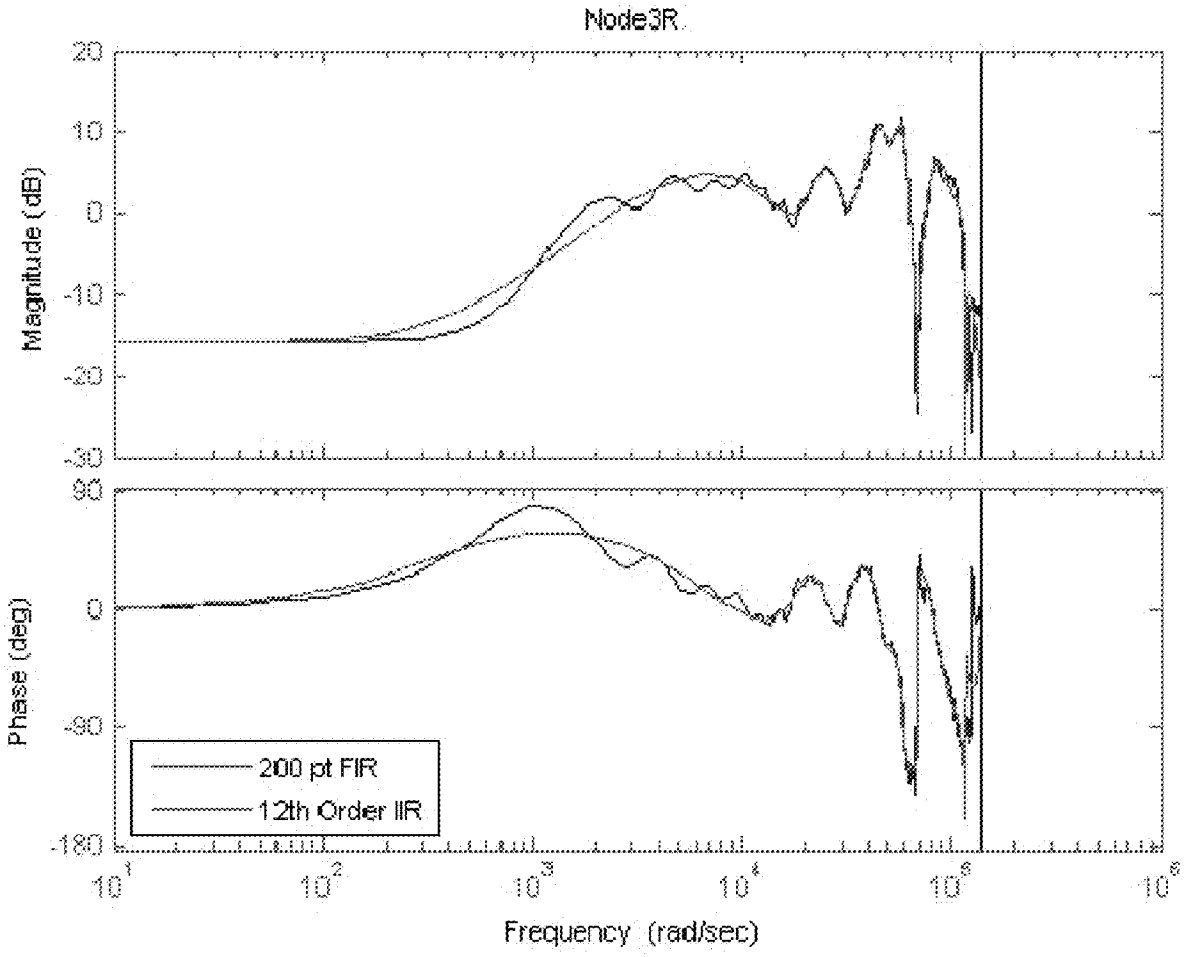
FIG. 15 is a graphical representation illustrating example results of a SISO IIR approximation using balanced realization for a third right node according to one or more embodiments described herein.
Figure 16:
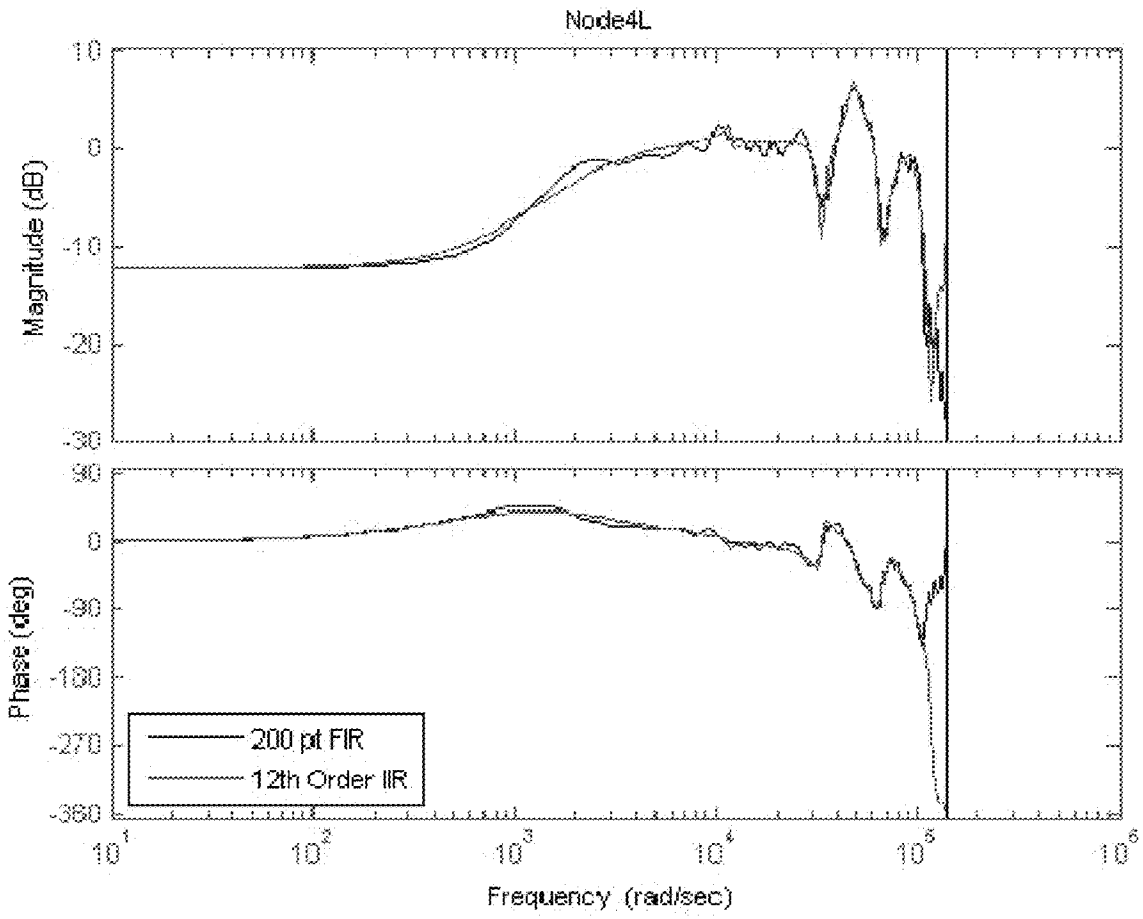
FIG. 16 is a graphical representation illustrating example results of a SISO IIR approximation using balanced realization for a fourth left node according to one or more embodiments described herein.
Figure 17:
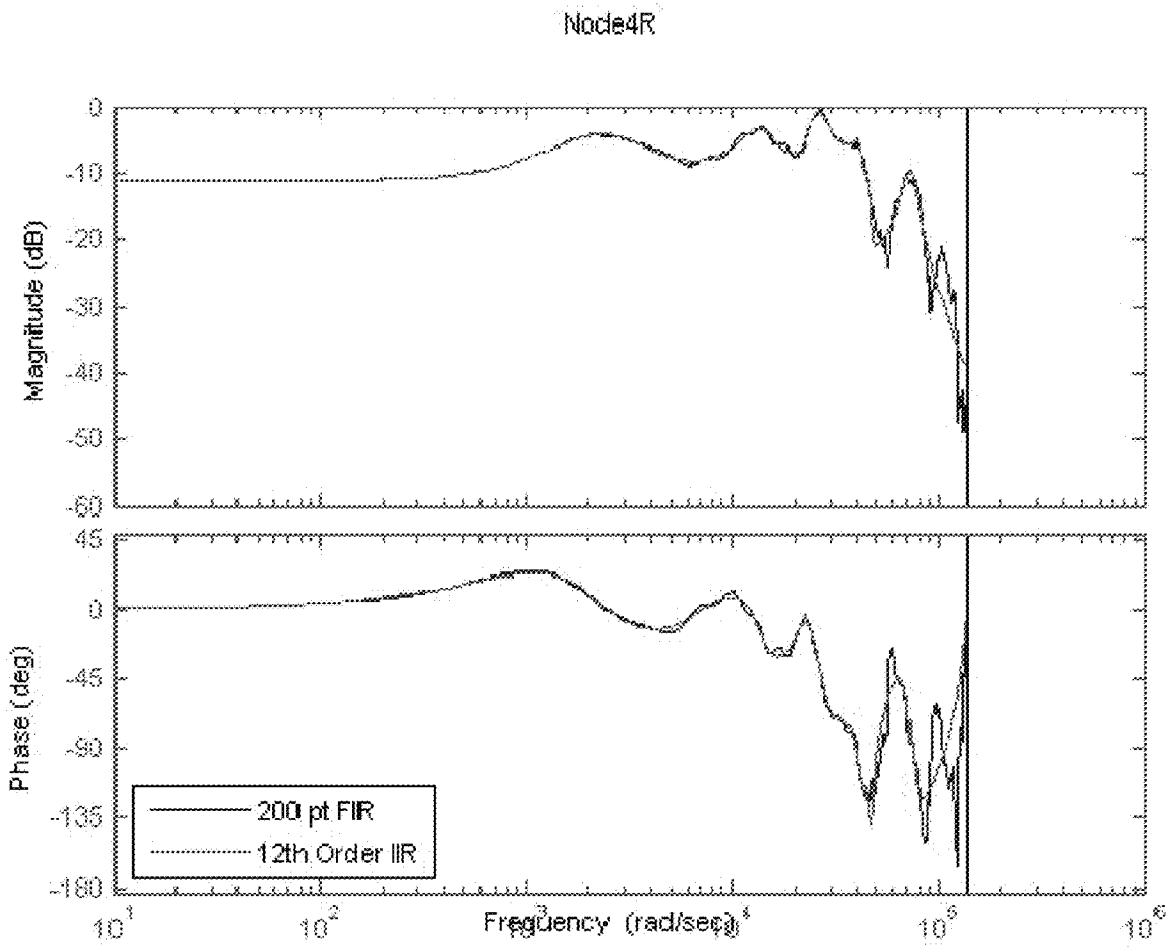
FIG. 17 is a graphical representation illustrating example results of a SISO IIR approximation using balanced realization for a fourth right node according to one or more embodiments described herein.

FIG. 9 is a high-level block diagram of an exemplary computing device (900) that is arranged for binaural rendering by reducing the number of arithmetic operations needed to implement the (e.g., 2M) filter functions in accordance with one or more embodiments described herein. In a very basic configuration (901), the computing device (900) typically includes one or more processors (910) and system memory (920). A memory bus (930) can be used for communicating between the processor (910) and the system memory (920).

Depending on the desired configuration, the processor (910) can be of any type including but not limited to a microprocessor (μP), a microcontroller (μC), a digital signal processor (DSP), or the like, or any combination thereof. The processor (910) can include one more levels of caching, such as a level one cache (911) and a level two cache (912), a processor core (913), and registers (914). The processor core (913) can include an arithmetic logic unit (ALU), a floating point unit (FPU), a digital signal processing core (DSP Core), or the like, or any combination thereof. A memory controller (915) can also be used with the processor (910), or in some implementations the memory controller (915) can be an internal part of the processor (910).

Depending on the desired configuration, the system memory (920) can be of any type including, but not limited to, volatile memory (such as RAM), non-volatile memory (such as ROM, flash memory, etc.) or any combination thereof. System memory (920) typically includes an operating system (921), one or more applications (922), and program data (924). The application (922) may include a system for binaural rendering (923). In accordance with at least one embodiment of the present disclosure, the system for binaural rendering (923) is designed to reduce the computational complexities of the binaural rendering process. For example, the system for binaural rendering (923)

is capable of reducing the number of arithmetic operations needed to implement the 2M filter functions described above.

Program Data (924) may include stored instructions that, when executed by the one or more processing devices, implement a system (923) and method for binaural rendering. Additionally, in accordance with at least one embodiment, program data (924) may include audio data (925), which may relate to, for example, multi-channel audio signal data from one or more virtual loudspeakers. In accordance with at least some embodiments, the application (922) can be arranged to operate with program data (924) on an operating system (921).

The computing device (900) can have additional features or functionality, and additional interfaces to facilitate communications between the basic configuration (901) and any required devices and interfaces.

System memory (920) is an example of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 900. Any such computer storage media can be part of the device (900).

The computing device (900) may be implemented as a portion of a small-form factor portable (or mobile) electronic device such as a cell phone, a smartphone, a personal data assistant (PDA), a personal media player device, a tablet computer (tablet), a wireless web-watch device, a personal headset device, an application-specific device, or a hybrid device that include any of the above functions. In addition, the computing device (900) may also be implemented as a personal computer including both laptop computer and non-laptop computer configurations, one or more servers, Internet-of-Things systems, and the like.

Figure 18:
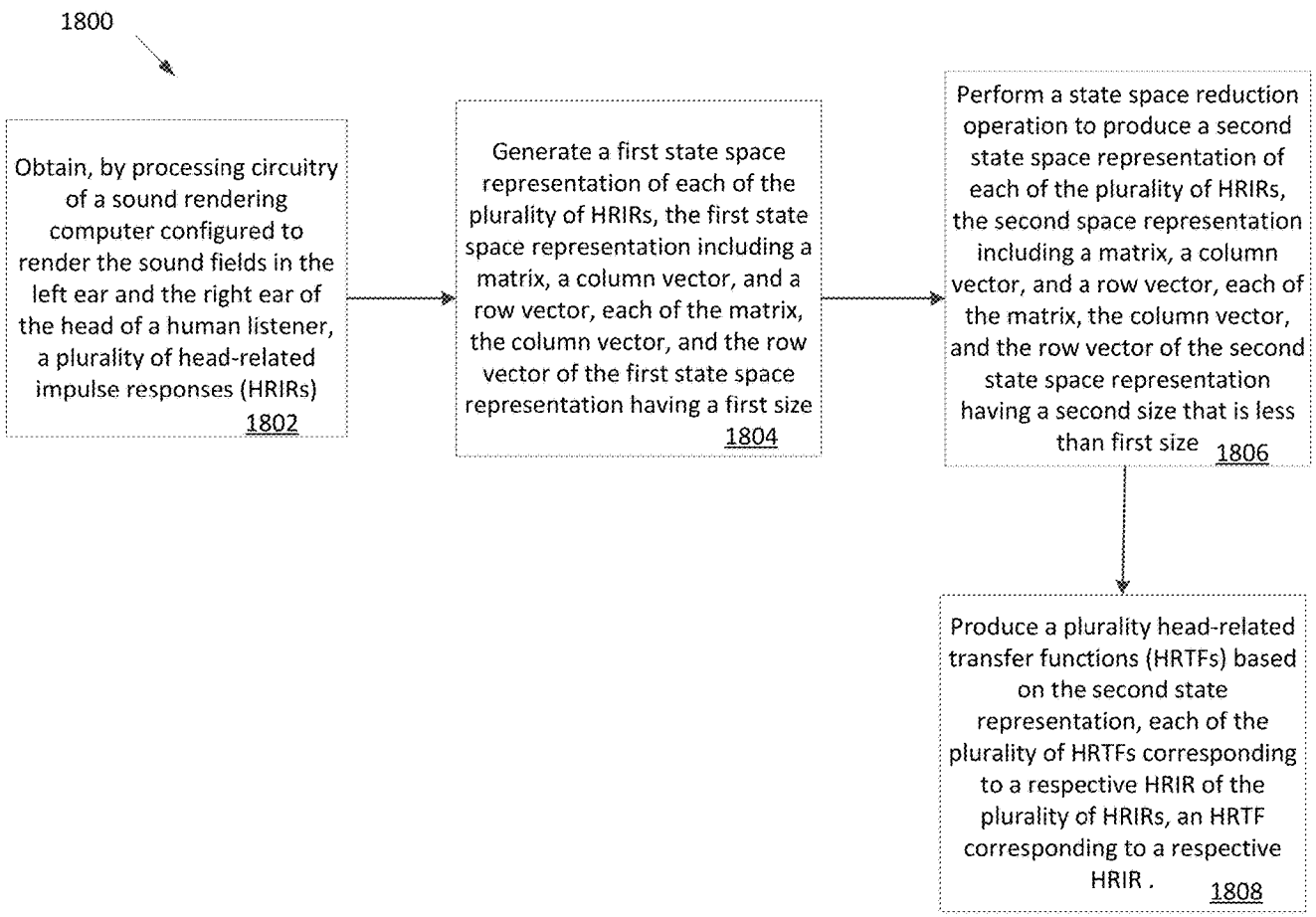
FIG. 18 is a flow chart illustrating an example method of performing the improved techniques described herein.

FIG. 18 illustrates an example method 1800 of performing binaural rendering. The method 1800 may be performed by software constructs described in connection with FIG. 9, which reside in memory 920 of the computing device 900 and are run by the processor 910.

At 1802, the computing device 900 obtains each of the plurality of HRIRs associated with a virtual loudspeaker of the plurality of virtual loudspeakers and an ear of the human listener. Each of the plurality of HRIRs includes samples of a sound field produced at a specified sampling rate in a left or right ear produced in response to an audio impulse produced by that virtual loudspeaker.

At 1804, the computing device 900 generates a first state space representation of each of the plurality of HRIRs. The first state space representation includes a matrix, a column vector, and a row vector. Each of the matrix, the column vector, and the row vector of the first state space representation has a first size.

At 1806, the computing device 900 performs a state space reduction operation to produce a second state space representation of each of the plurality of HRIRs. The second space representation includes a matrix, a column vector, and a row vector. Each of the matrix, the column vector, and the row vector of the second state space representation has a second size that is less than first size.

At 1808, the computing device 900 produces a plurality head-related transfer functions (HRTFs) based on the second state representation. Each of the plurality of HRTFs corresponds to a respective HRIR of the plurality of HRIRs. An HRTF corresponding to a respective HRIR produces, upon multiplication by a frequency-domain sound field produced by the virtual loudspeaker with which the respective HRIR is associated, a component of a sound field rendered in an ear of the human listener.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In accordance with at least one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers, as one or more programs running on one or more processors, as firmware, or as virtually any combination thereof, and that designing the circuitry and/or writing the code for the software and or firmware would be well within the skill of one of skill in the art in light of this disclosure.

In addition, those skilled in the art will appreciate that the mechanisms of the subject matter described herein are capable of being distributed as a program product in a variety of forms, and that an illustrative embodiment of the subject matter described herein applies regardless of the particular type of non-transitory signal bearing medium used to actually carry out the distribution. Examples of a non-transitory signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A method of rendering sound fields in a left ear and a right ear of a human listener, the sound fields being produced by a plurality of virtual loudspeakers, the method comprising:

obtaining, by processing circuitry of a sound rendering computer configured to render the sound fields in the left ear and the right ear of the head of the human listener, a plurality of head-related impulse responses (HRIRs), each of the plurality of HRIRs being associated with a virtual loudspeaker of the plurality of virtual loudspeakers and the left or right ear of the human listener, each of the plurality of HRIRs including samples of a sound field produced at a specified sampling rate in the left or right ear produced in response to an audio impulse produced by that virtual loudspeaker;

generating a first state space representation of each of the plurality of HRIRs, the first state space representation including a matrix, a column vector, and a row vector, each of the matrix, the column vector, and the row vector of the first state space representation having a first size;

performing a state space reduction operation to produce a second state space representation of each of the plurality of HRIRs, the second state space representation including a matrix, a column vector, and a row vector, each of the matrix, the column vector, and the row vector of the second state space representation having a second size that is less than the first size; and producing a plurality of head-related transfer functions (HRTFs) based on the second state space representation, each of the plurality of HRTFs corresponding to a respective HRIR of the plurality of HRIRs, an HRTF corresponding to the respective HRIR producing, upon multiplication by a frequency-domain sound field produced by the virtual loudspeaker with which the respective HRIR is associated, a component of the sound field rendered in the left or right ear of the human listener.

2. The method as in claim 1, wherein performing the state space reduction operation includes, for each HRIR of the plurality of HRIRs:

generating a respective Gramian matrix based on the first state space representation of that HRIR, the Gramian matrix having a plurality of eigenvalues arranged in descending order of magnitude; and generating the second state space representation of that HRIR based on the Gramian matrix and the plurality of eigenvalues, wherein the second size is equal to a number of eigenvalues of the plurality of eigenvalues greater than a specified threshold.

3. The method as in claim 2, wherein generating the second state space representation of each HRIR of the plurality of HRIRs includes forming a transformation matrix that, when applied to the Gramian matrix that is based on the first state space representation of that HRIR, produces a diagonal matrix, each diagonal element of the diagonal matrix being equal to a respective eigenvalue of the plurality of eigenvalues.

4. The method as in claim 1, further comprising, for each of the plurality of HRIRs:

generating a cepstrum of that HRIR, the cepstrum having causal samples taken at positive times and non-causal samples taken at negative times;

for each of the non-causal samples of the cepstrum, performing a phase minimization operation by adding that non-causal sample taken at a negative time to a causal sample of the cepstrum taken at the opposite of that negative time; and producing a minimum-phase HRIR by setting each of the non-causal samples of the cepstrum to zero after performing the phase minimization operation for each of the non-causal samples of the cepstrum.

5. The method as in claim 1, further comprising generating a multiple input, multiple output (MIMO) state space representation, the MIMO state space representation including a composite matrix, a column vector matrix, and a row vector matrix, the composite matrix of the MIMO state space representation including the matrix of the first state space representation of each of the plurality of HRIRs, the column vector matrix of the MIMO state space representation including the column vector of the first state space representation of each of the plurality of HRIRs, the row vector matrix of the MIMO state space representation including the row vector of the first state space representation of each of the plurality of HRIRs; and wherein performing the state space reduction operation includes generating a reduced composite matrix, a reduced column vector matrix, and a reduced row vector matrix, each of the reduced composite matrix, reduced column vector matrix, and reduced row vector matrix having a size that is respectively less than a size of the composite matrix, the column vector matrix, and the row vector matrix.

6. The method as in claim 5, wherein generating the MIMO state space representation includes:

forming, as the composite matrix of the MIMO state space representation, a first block matrix having a matrix of the first state space representation of an HRIR associated with a virtual loudspeaker of the plurality of virtual loudspeakers as a diagonal element of the first block matrix, matrices of the first state space representation of HRIRs associated with the same virtual loudspeaker being in adjacent diagonal elements of the first block matrix;

forming, as the column vector matrix of the MIMO state space representation, a second block matrix having a column vector of the first state space representation of an HRIR associated with a virtual loudspeaker of the plurality of virtual loudspeakers as a diagonal element of the second block matrix, column vectors of the first state space representation of HRIRs associated with the same virtual loudspeaker being in adjacent diagonal elements of the second block matrix; and forming, as the row vector matrix of the MIMO state space representation, a third block matrix having a row vector of the first state space representation of an HRIR associated with a virtual loudspeaker of the plurality of virtual loudspeakers as an element of the third block matrix, row vectors of the first state space representation of HRIRs that render sounds in the left ear being in odd-numbered elements of a first row of the third block matrix, row vectors of the first state space representation of HRIRs that render sounds in the right ear being in even-numbered elements of a second row of the third block matrix.

7. The method as in claim 5, further comprising, prior to generating the MIMO state space representation, for each HRIR of the plurality of HRIRs, performing a single input single output (SISO) state space reduction operation to produce, as the first state space representation of that HRIR, a SISO state space representation of that HRIR.

8. The method as in claim 1, wherein, for each of the plurality of virtual loudspeakers, there are a left HRIR and a right HRIR of the plurality of HRIRs associated with that virtual loudspeaker, the left HRIR producing, upon multiplication by the frequency-domain sound field produced by that virtual loudspeaker, the component of the sound field rendered in the left ear of the human listener, the right HRIR producing, upon multiplication by the frequency-domain sound field produced by that virtual loudspeaker, the component of the sound field rendered in the right ear of the human listener; and wherein, for each of the plurality of virtual loudspeakers, there is an interaural time delay (ITD) between the left HRIR associated with that virtual loudspeaker and the right HRIR associated with that virtual loudspeaker, the ITD being manifested in the left HRIR and the right HRIR by a difference between a number of initial samples of the sound field of the left HRIR that have zero values and a number of initial samples of the sound field of the right HRIR that have zero values.

9. The method as in claim 8, further comprising:

generating an ITD unit subsystem matrix based on the ITD between the left HRIR and right HRIR associated with each of the plurality of virtual loudspeakers; and multiplying the plurality of HRTFs by the ITD unit subsystem matrix to produce a plurality of delayed HRTFs.

10. The method as in claim 1, wherein each of the plurality of HRTFs are represented by finite impulse filters (FIRs); and wherein the method further comprises performing a conversion operation on each of the plurality of HRTFs to produce another plurality of HRTFs that are each represented by infinite impulse response filters (IIRs).

11. A computer program product comprising a nontransitive storage medium, the computer program product including code that, when executed by processing circuitry of a sound rendering computer configured to render sound fields in a left ear and a right ear of a human listener, causes the processing circuitry to perform a method, the method comprising:

obtaining a plurality of head-related impulse responses (HRIRs), each of the plurality of HRIRs being associated with a virtual loudspeaker of a plurality of virtual loudspeakers and the left or right ear of the human listener, each of the plurality of HRIRs including samples of a sound field produced at a specified sampling rate in the left or right ear produced in response to an audio impulse produced by that virtual loudspeaker;

generating a first state space representation of each of the plurality of HRIRs, the first state space representation including a matrix, a column vector, and a row vector, each of the matrix, the column vector, and the row vector of the first state space representation having a first size;

performing a state space reduction operation to produce a second state space representation of each of the plurality of HRIRs, the second state space representation including a matrix, a column vector, and a row vector, each of the matrix, the column vector, and the row vector of the second state space representation having a second size that is less than the first size; and producing a plurality of head-related transfer functions (HRTFs) based on the second state space representation, each of the plurality of HRTFs corresponding to a respective HRIR of the plurality of HRIRs, an HRTF corresponding to a respective HRIR producing, upon multiplication by a frequency-domain sound field produced by the virtual loudspeaker with which the respective HRIR is associated, a component of a sound field rendered in the left or right ear of the human listener.

12. The computer program product as in claim 11, wherein performing the state space reduction operation includes, for each HRIR of the plurality of HRIRs:

generating a respective Gramian matrix based on the first state space representation of that HRIR, the Gramian matrix having a plurality of eigenvalues arranged in descending order of magnitude; and generating the second state space representation of that HRIR based on the Gramian matrix and the plurality of eigenvalues, wherein the second size is equal to a number of eigenvalues of the plurality of eigenvalues greater than a specified threshold.

13. The computer program product as in claim 12, wherein generating the second state space representation of each HRIR of the plurality of HRIRs includes forming a transformation matrix that, when applied to the Gramian matrix that is based on the first state space representation of that HRIR, produces a diagonal matrix, each diagonal element of the diagonal matrix being equal to a respective eigenvalue of the plurality of eigenvalues.

14. The computer program product as in claim 11, wherein the method further comprises, for each of the plurality of HRIRs:

generating a cepstrum of that HRIR, the cepstrum having causal samples taken at positive times and non-causal samples taken at negative times;

for each of the non-causal samples of the cepstrum, performing a phase minimization operation by adding that non-causal sample taken at a negative time to a causal sample of the cepstrum taken at the opposite of that negative time; and producing a minimum-phase HRIR by setting each of the non-causal samples of the cepstrum to zero after performing the phase minimization operation for each of the non-causal samples of the cepstrum.

15. The computer program product as in claim 11, wherein the method further comprises generating a multiple input, multiple output (MIMO) state space representation, the MIMO state space representation including a composite matrix, a column vector matrix, and a row vector matrix, the composite matrix of the MIMO state space representation including the matrix of the first state space representation of each of the plurality of HRIRs, the column vector matrix of the MIMO state space representation including the column vector of the first state space representation of each of the plurality of HRIRs, the row vector matrix of the MIMO state space representation including the row vector of the first state space representation of each of the plurality of HRIRs; and wherein performing the state space reduction operation includes generating a reduced composite matrix, a reduced column vector matrix, and a reduced row vector matrix, each of the reduced composite matrix, reduced column vector matrix, and reduced row vector matrix having a size that is respectively less than a size of the composite matrix, the column vector matrix, and the row vector matrix.

16. The computer program product as in claim 15, wherein generating the MIMO state space representation includes:

forming, as the composite matrix of the MIMO state space representation, a first block matrix having a matrix of the first state space representation of an HRIR associated with a virtual loudspeaker of the plurality of virtual loudspeakers as a diagonal element of the first block matrix, matrices of the first state space representation of HRIRs associated with the same virtual loudspeaker being in adjacent diagonal elements of the first block matrix;

forming, as the column vector matrix of the MIMO state space representation, a second block matrix having a column vector of the first state space representation of an HRIR associated with a virtual loudspeaker of the plurality of virtual loudspeakers as a diagonal element of the second block matrix, column vectors of the first state space representation of HRIRs associated with the same virtual loudspeaker being in adjacent diagonal elements of the second block matrix; and forming, as the row vector matrix of the MIMO state space representation, a third block matrix having a row vector of the first state space representation of an HRIR associated with a virtual loudspeaker of the plurality of virtual loudspeakers as an element of the third block matrix, row vectors of the first state space representation of HRIRs that render sounds in the left ear being in odd-numbered elements of a first row of the third block matrix, row vectors of the first state space representation of HRIRs that render sounds in the right ear being in even-numbered elements of a second row of the third block matrix.

17. The computer program product as in claim 11, wherein, for each of the plurality of virtual loudspeakers, there are a left HRIR and a right HRIR of the plurality of HRIRs associated with that virtual loudspeaker, the left HRIR producing, upon multiplication by the frequency-domain sound field produced by that virtual loudspeaker, the component of the sound field rendered in the left ear of the human listener, the right HRIR producing, upon multiplication by the frequency-domain sound field produced by that virtual loudspeaker, the component of the sound field rendered in the right ear of the human listener; and wherein, for each of the plurality of virtual loudspeakers, there is an interaural time delay (ITD) between the left HRIR associated with that virtual loudspeaker and the right HRIR associated with that virtual loudspeaker, the ITD being manifested in the left HRIR and the right HRIR by a difference between a number of initial samples of the sound field of the left HRIR that have zero values and a number of initial samples of the sound field of the right HRIR that have zero values.

18. The computer program product as in claim 17, wherein the method further comprises:

generating an ITD unit subsystem matrix based on the ITD between the left HRIR and right HRIR associated with each of the plurality of virtual loudspeakers; and multiplying the plurality of HRTFs by the ITD unit subsystem matrix to produce a plurality of delayed HRTFs.

19. The computer program product as in claim 11, wherein each of the plurality of HRTFs are represented by finite impulse filters (FIRs); and wherein the method further comprises performing a conversion operation on each of the plurality of HRTFs to produce another plurality of HRTFs that are each represented by infinite impulse response filters (IIRs).

20. An electronic apparatus configured to render sound fields in a left ear and a right ear of a human listener, the electronic apparatus comprising:

memory; and controlling circuitry coupled to the memory, the controlling circuitry being configured to:

obtain a plurality of head-related impulse responses (HRIRs), each of the plurality of HRIRs being associated with a virtual loudspeaker of a plurality of virtual loudspeakers and the left or right ear of the human listener, each of the plurality of HRIRs including samples of a sound field produced at a specified sampling rate in the left or right ear produced in response to an audio impulse produced by that virtual loudspeaker;

generate a first state space representation of each of the plurality of HRIRs, the first state space representation including a matrix, a column vector, and a row vector, each of the matrix, the column vector, and the row vector of the first state space representation having a first size;

perform a state space reduction operation to produce a second state space representation of each of the plurality of HRIRs, the second state space representation including a matrix, a column vector, and a row vector, each of the matrix, the column vector, and the row vector of the second state space representation having a second size that is less than the first size; and produce a plurality of head-related transfer functions (HRTFs) based on the second state space representation, each of the plurality of HRTFs corresponding to a respective HRIR of the plurality of HRIRs, an HRTF corresponding to a respective HRIR producing, upon multiplication by a frequency-domain sound field produced by the virtual loudspeaker with which the respective HRIR is associated, a component of a sound field rendered in the left or right ear of the human listener.

* * * * *